US005745137A

United States Patent [19]

Scheffelin et al.

[11] Patent Number: 5,745,137

[45] Date of Patent: Apr. 28, 1998

[54] CONTINUOUS REFILL OF SPRING BAG RESERVOIR IN AN INK-JET SWATH PRINTER/PLOTTER

[75] Inventors: Joseph E. Scheffelin, San Diego; Mark E. Young, Escondido; Elizabeth Zapata, San Diego; Kenneth J. Courian, San Diego; George T. Kaplinsky, San Diego; David W. Swanson, Escondido, all of Calif.; James E. Clark, Albany, Oreg.; Tofigh Khodapanah, San Diego, Calif.

[73] Assignee: Hewlett-Packard Company, Palo Alto, Calif.

[21] Appl. No.: 454,975

[22] Filed: May 31, 1995

Related U.S. Application Data

[63] Continuation-in-part of Ser. No. 995,851, Dec. 23, 1992, which is a continuation-in-part of Ser. No. 929,615, Aug. 12, 1992, abandoned.

[51] Int. Cl.[6] ..... B41J 2/175

[52] U.S. Cl. ..... 347/85; 347/50

[58] Field of Search ..... 347/85, 50, 86, 347/87

[56] References Cited

U.S. PATENT DOCUMENTS

| | | | |
|---|---|---|---|
| 4,223,323 | 9/1980 | Bader et al. | 346/140 R |
| 4,412,232 | 10/1983 | Weber et al. | 347/86 |
| 4,500,895 | 2/1985 | Buck et al. | 346/140 R |
| 4,714,937 | 12/1987 | Kaplinsky | 345/140 R |
| 4,831,389 | 5/1989 | Chan | 346/140 R |
| 4,833,491 | 5/1989 | Rezanka | 346/140 R |
| 4,929,963 | 5/1990 | Balazar | 346/1.1 |
| 4,959,667 | 9/1990 | Kaplinsky | 345/140 R |
| 4,967,207 | 10/1990 | Ruder | 346/140 R |
| 4,968,998 | 11/1990 | Allen | 346/140 R |
| 4,970,528 | 11/1990 | Beaufort et al. | 346/25 |
| 5,121,132 | 6/1992 | Pan et al. | 346/1.1 |
| 5,136,305 | 8/1992 | Ims | 346/1.1 |
| 5,280,300 | 1/1994 | Fong et al. | 346/1.1 |
| 5,329,294 | 7/1994 | Ontawar et al. | 397/87 |
| 5,359,353 | 10/1994 | Hunt et al. | 347/86 |
| 5,367,328 | 11/1994 | Erickson | 347/7 |
| 5,369,429 | 11/1994 | Erickson | 347/7 |

*Primary Examiner*—Safet Metjahic
*Assistant Examiner*—Michael Dalakis

[57] ABSTRACT

A closed ink replenishment system for replenishing the supply of ink in negative pressure spring-bag reservoirs in a printer/plotter. A tube runs between each cartridge reservoir and an auxiliary reservoir mounted to the printer/plotter frame to form the closed ink system. As ink is depleted from the spring-bag reservoir during printing operation, the negative pressure in the cartridge increases, drawing ink through the tube from the auxiliary reservoir into the cartridge until the negative pressure decreases to an equilibrium point. As a result, the volume of ink within the spring-bag reservoir remains substantially constant so long as there is ink remaining within the auxiliary reservoir. This maintains the print quality. The auxiliary reservoir is a flat bag mounted on a spring-biased platform, which acts as a height regulating system. As ink is depleted from the auxiliary bag, the height of the platform and bag increases to maintain a constant pressure and elevation head at the spring-bag reservoir.

46 Claims, 18 Drawing Sheets

CONTINUOUS REFILL OF SPRING BAG RESERVOIR IN AN INK-JET SWATH PRINTER/PLOTTER

This is a continuation-in-part of commonly assigned application Ser. No. 07/995,851 filed Dec. 23, 1992, entitled "NEGATIVE PRESSURE INK DELIVERY SYSTEM," by George T. Kaplinsky et al. which is a continuation-in-part of application Ser. No. 07/929,615 filed Aug. 12, 1992, entitled "COLLAPSIBLE INK RESERVOIR STRUCTURE AND PRINTER INK CARTRIDGE" by George T. Kaplinsky et al. now abandoned.

TECHNICAL FIELD OF THE INVENTION

The present invention is related to the following pending U.S. patent applications: COMPACT FLUID COUPLER FOR THERMAL INK JET PRINT CARTRIDGE AND RESERVOIR, Ser. No. 07/853,372, filed Mar. 18, 1992, by James G. Salter et al.; INK PRESSURE REGULATOR FOR A THERMAL INK-JET PRINTER, Ser. No. 07/928,811, filed Aug. 12, 1992, by Tofigh Khodapanah et al.; COLLAPSIBLE INK RESERVOIR STRUCTURE AND PRINTER INK CARTRIDGE, Ser. No. 07/929,615, filed Aug. 12, 1992, by George T. Kaplinsky et al.; TWO MATERIAL FRAME HAVING DISSIMILAR PROPERTIES FOR A THERMAL INK-JET CARTRIDGE, by David S. Swanson et al., Ser. No. 07/994,807, filed Dec. 22, 1992; RIGID LOOP CASE STRUCTURE FOR THERMAL INK-JET PEN, by David W. Swanson et al., Ser. No. 07/995,221, filed Dec. 22, 1992; THERMAL INK-JET PEN WITH A PLASTIC/METAL ATTACHMENT FOR THE COVER, by Dale D. Timm, Jr. et al., Ser. No. 07/994,810, filed Dec. 22, 1992; THIN PEN STRUCTURE FOR THERMAL INK-JET PRINTER, by David W. Swanson et al., Ser. No. 07/994,809, filed Dec. 22, 1992; DOUBLE COMPARTMENT INK-JET CARTRIDGE WITH OPTIMUM SNOUT, by David W. Swanson et al., Ser. No. 07/995,221, filed Dec. 22, 1992; LAMINATED FILM INK RESERVOIR, by Joseph Scheffelin, Ser. No. 07/995,868, filed Dec. 23, 1992; SPRING BAG PRINTER INK CARTRIDGE WITH VOLUME INDICATOR, by David S. Hunt et al., Ser. No. 07/717,735, filed Jun. 19, 1991; INK-JET SWATH PRINTER WITH AUXILIARY INK RESERVOIR, by Jaime H. Bohorquez et al., filed concurrently herewith, Attorney Docket Number 10950575-1, the entire disclosures of which are incorporated herein by this reference.

BACKGROUND OF THE INVENTION

This invention relates to thermal ink-jet (TIJ) printers, and more particularly to improvements in the pens used therein.

TIJ printers typically include a TIJ pen which includes a reservoir of ink coupled to the TIJ printhead. One type of pen includes a polymer foam disposed within the print reservoir so that the capillary action of the foam will prevent ink from leaking or drooling from the printhead. In such a foam-pen, an air-vented delivery system is provided wherein air enters the reservoir via a separate vent opening to replace ink which is dispensed from the reservoir through the printhead.

A different type of TIJ printer has an ink reservoir which is ordinarily maintained under a sub-atmospheric or negative pressure so that ink will not leak or drool from the printhead. Various types of ink reservoirs may be used including refillable ink reservoir cartridges which are mounted on the moveable printer carriage, throwaway replaceable cartridges which are mounted on the printer carriage, and remote or offboard ink reservoirs from which ink is brought to the printhead on the printer carriage by tubing.

A collapsible ink reservoir for an inkjet printer is disclosed in U.S. Pat. No. 4,422,084, issued Dec. 20, 1983, to Saito. Negative pressure is maintained in a polypropylene ink bag by various types of springs which bias the bag walls apart from each other. The springs may be mounted inside of or externally of the ink bag, but the spring pressure regulator construction does not result in substantially complete emptying of the ink bag and the bag itself is not carried on a printer carriage.

Another ink reservoir which achieves constant negative back pressure through an external spring or an elastomeric bladder is disclosed in U.S. Pat. No. 4,509,062, issued Apr. 2, 1985.

Large format ink-jet printer/plotters such as the DESIGNJET series sold by Hewlett-Packard Company offer substantial improvements in speed over the conventional X-Y vector plotter. Ink-jet printer/plotters typically include a plurality of print cartridges, each having a print head with an array of nozzles. The cartridges are mounted in a carriage which is moved across the page in successive swaths. Each ink-jet print head has heater circuits which when activated cause ink to be ejected from associated nozzles. As the cartridge is positioned over a given location, a jet of ink is ejected from the nozzle to provide a pixel of ink at a desired location. The mosaic of pixels thus created provides a desired composite image.

Recently, full color ink-jet printer/plotters have been developed which comprise a plurality of ink-jet cartridges of diverse colors. A typical color ink-jet printer/plotter has four ink-jet print cartridges, one for black ink (K), and three for color inks, magenta (M), cyan (C) and yellow (Y). The colors from the three color cartridges are mixed to obtain a full spectrum of color. The cartridges are typically mounted in stalls within an assembly which is mounted on the carriage of the printer/plotter. The carriage assembly positions the ink-jet cartridges and typically holds the circuitry required for interface to the heater circuits in the ink-jet cartridges.

Large scale printer/plotters have been developed which use cartridges with internal spring-bag reservoirs. Because of the volume of ink used in creating many plots, as well as the heavy usage to which the devices are put, the user must intervene to replace cartridges whose internal reservoirs have been depleted of ink. This can lead to expensive waste if a large scale plot is commenced, but must be discarded because one or more of the cartridges runs out of ink. The print media on which such plots are made is typically relatively expensive. Moreover, time is lost in commencing a large plot only to have to discard the plot because one of the cartridges runs out of ink before the plot is finished.

Thus there is a need in the art for systems and techniques for providing an increased supply of ink in printer/plotters employing spring-bag cartridges.

SUMMARY OF THE INVENTION

An ink-jet printer/plotter for ink-jet printing onto a print media is described, and comprises an ink-jet cartridge including an ink-jet print head and a closed spring-bag primary ink reservoir in fluid communication with the print head for holding an internal supply of liquid ink under negative pressure. The reservoir including a movable side wall and an internal spring for biasing the side wall against collapsing as ink is withdrawn from the reservoir and ejected from the print head onto a print medium during printing operations. The printer/plotter includes a frame and a print media advancing mechanism for advancing a print medium along a medium path in a media advance direction to a print area. A cartridge carriage holds the cartridge in a registered position, and a cartridge carriage drive mechanism moves the cartridge carriage relative to the frame along a carriage axis for printing a swath.

In accordance with the invention, an auxiliary ink reservoir is secured relative to the frame for holding an auxiliary supply of liquid ink. A connection tube runs between the primary reservoir and the auxiliary reservoir for providing a closed fluid path between the primary and auxiliary reservoirs. The printer/plotter includes means for positioning the auxiliary reservoir at a height position relative to the spring bag internal reservoir so as not to destroy the back pressure. Preferably, the height position of the auxiliary reservoir is below a height at which the print head is disposed while the cartridge is secured in the carriage for printing operation.

The auxiliary reservoir holds a large quantity of liquid ink to result in little variation in back pressure as ink is consumed. In a preferred embodiment, the auxiliary reservoir is a flat bag with relative large depth and width dimensions.

In accordance with another aspect of the invention, the auxiliary reservoir is supported by a spring-biased platform whose height varies as the weight of the auxiliary reservoir changes. As ink is withdrawn from the auxiliary reservoir to replenish the spring-bag reservoir, the reservoir weight decreases, and the platform and reservoir rise. This maintains a constant pressure and elevation head in the ink replenishment system.

DETAILED DESCRIPTION OF THE PREFERRED EMBODIMENT

Figure 1:
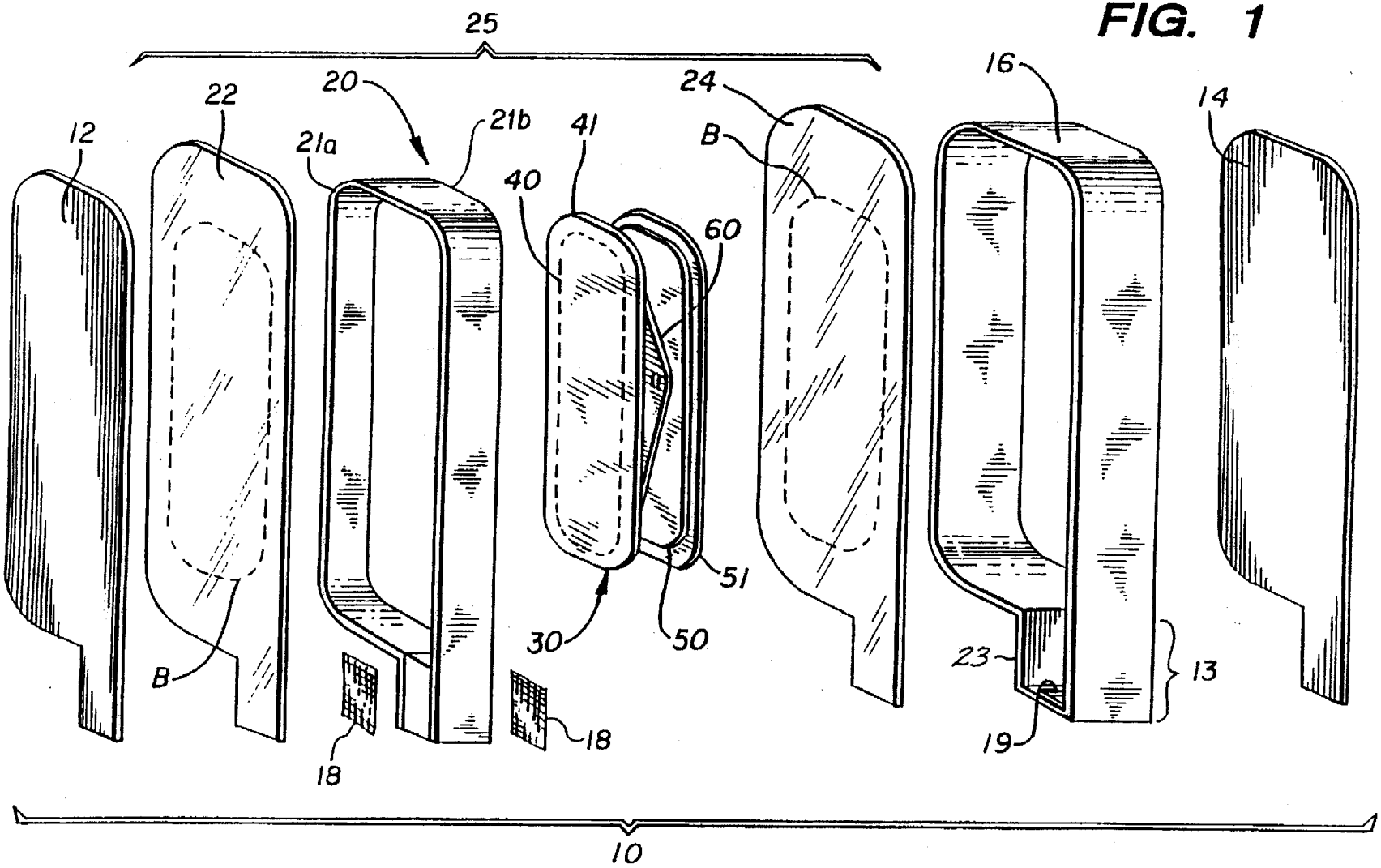
FIG. 1 is an exploded perspective view of a replaceable or throwaway ink cartridge of a presently preferred embodiment of the invention prior to assembly.

The drawing shows a replaceable ink cartridge comprising a rigid outer housing 10 having a pair of spaced cover plates 12, 14 intended to be affixed as by heat bonding, or adhesive, or preferably press fit through interlocking tabs to opposite sides of a plastic peripheral wall section 16. Snout portion 13 of the cartridge has an ink discharge aperture 19 in its lowermost end wall 23 (as seen in FIG. 1) to which is affixed an electrically driven printhead, not shown.

An inner collapsible reservoir structure unit 25 comprised of a relatively rigid inner plastic frame 20 and a pair of ink bag sidewalls 22, 24, at least one of which is a flexible membrane such as plastic, attached thereto is mounted in the outer housing 16. Preferably, inner frame 20 is molded with the outer housing 16 in a two-step injection molding process. Inner frame 20 is formed of a softer and lower melting point plastic than the plastic of housing 10 to permit heat bonding of the bag walls 22, 24 thereto. Alternatively, inner frame 20 may be separately constructed with some flexibility to assist in mounting it in the housing 16 but the frame 20 is rigid relative to the flexible ink bag membranes described below.

The frame 20 has a pair of opposite side edges **21*a* and 21*b* to which the flexible plastic ink bag members 22, 24 are respectively joined as by heat welding at their peripheral edges to form the reservoir structure 25. The reservoir structure 25 contains a pressure regulator 30 which in turn is preferably comprised of a pair of spaced substantially parallel metal sideplates 40, 50 urged apart by a bow spring 60 toward the flexible membranes 22, 24. The assembled reservoir structure including the inner frame 20, membranes 22, 24 and pressure regulator 30 is then mounted inside of wall section 16 of the cartridge and side walls 12, 14 are then affixed to the cartridge housing peripheral wall 16. The snout portion 13 of housing 16 also contains an ink filter 18 which is placed in fluid communication with the flexible ink bag reservoir. The filter 18 may be mounted inside the reservoir structure or it can be positioned outside of the reservoir structure but inside outer housing 16 with minor porting and seal modifications to ensure fluid communication from the ink reservoir to the filter 18. The lowermost portion of the peripheral outer housing wall 16 (as viewed in FIG. 1.) is provided with an ink discharge aperture 19 through which ink is downwardly discharged from the filter 18** to the printhead, not shown.

The pressure regulator sideplates 40, 50 may be individually cut from a continuous metal strip of metal such as stainless steel, each plate being of generally rectangular configuration with rounded corners to minimize damaging the flexible bag membranes.

The bow spring 60 also may conveniently be cut from a common strip of metal such as stainless steel.

The bow spring 60 is affixed preferably by spot or laser welding at the apexes of each of its bights centrally onto each of the sideplates 40, 50.

An edge guard in the form of a thin but tough polyethylene cover layer 41, 51 having an acrylic adhesive on one surface thereof may then be press bonded to the outer surface of each side plate 40, 50 if desired. The cover layers 41, 51 are each sized slightly larger than the side plates 40, 50 so that a marginal width of approximately 1.2 millimeters of the cover layers extends beyond each edge of the metal plates 40, 50 to prevent those edges from contacting the comparatively delicate plastic bag wall membranes 22, 24.

The pressure regulator 30 is centrally positioned in the frame 20 and housing 10 and the two flexible plastic ink bag sidewalls or membranes 22, 24 are then heat bonded or cemented at their peripheral edges to the edge wall 21 of the inner plastic frame 20, care being taken to maintain the central positioning at all times of the regulator and cover layers 41, 51 in the frame 20 between the flexible membrane walls 22, 24. The bag walls 22, 24 are then securely affixed to the pressure regulator 30 preferably by heat bonding the membrane bag walls 22, 24 to the cover layers 41, 51 in the area bonded by the broken line B. This heat bonding has the primary purpose of preventing relative motion between the pressure regulator 30 and preventing direct contact of the metal sideplates 40, 50 with the relatively delicate membrane bag walls 22, 24 to prevent the edges of the sideplates from cutting or puncturing the membranes. In the absence of any protective cover layers, the bag walls may be directly bonded by heat bonding or suitable adhesive to the pressure regulator. Either method of construction also reduces the area of ink contact with the membrane walls 22, 24 which in turn minimizes the migration of moisture from the ink through the membranes. Such migration, over time, degrades the ink quality and this problem is thus minimized. In one embodiment the dimensions of the dashed line area of heat bonding are approximately 8 mm by 29 mm, and the heat bond area is centrally located on the sideplates 40, 50. In another embodiment, the regulator sideplates and bag sidewalls are initially assembled to be in moveable contact with each other. Thereafter, a heated platen momentarily contacts the film and fuses the film to the plate. A slight vacuum must be applied to the inside of the frame to improve the quality of the fusion.

As ink is withdrawn from the reservoir bag, the flexible sidewalls 22, 24 of the ink bag and the pressure regulator sideplates 50, 50 gradually move toward each other until the spring is in an essentially flat configuration with the two sideplates 50, 50 coming virtually into contact with each other so that the bag is substantially completely emptied of ink.

Persons skilled in the art will readily appreciate that various modifications can be made from the preferred embodiment, thus the scope of protection is intended to be defined only by the limitations of the appended claims. For example, the cover layers 41, 51 may in some instances be unnecessary and an ink bag having a single flexible membrane wall instead of two flexible membrane walls might be constructed. In this instance, the pressure regulator need only have a single sideplate urged into engagement by a spring with the single flexible membrane bag wall.

It is therefore understood from the foregoing description that the invention provides a bonding technique to assure that the regulator is centrally positioned and always held in its proper place between the flexible membrane bag walls, preferably by heat bonding of the bag walls to an edge guard layer covering the outer surface of the two sideplates 40, 50.

In such a preferred embodiment of the invention, inadvertent puncture of the thin bag walls by the regulator is prevented by a protective edge guard in the form of a layer of tough plastic bonded to the outer surface of the sideplates, the protective layers each having a peripheral edge which extends beyond the edge of the sideplate to prevent the edges of the sideplates from directly contacting the bag walls.

Figure 2:
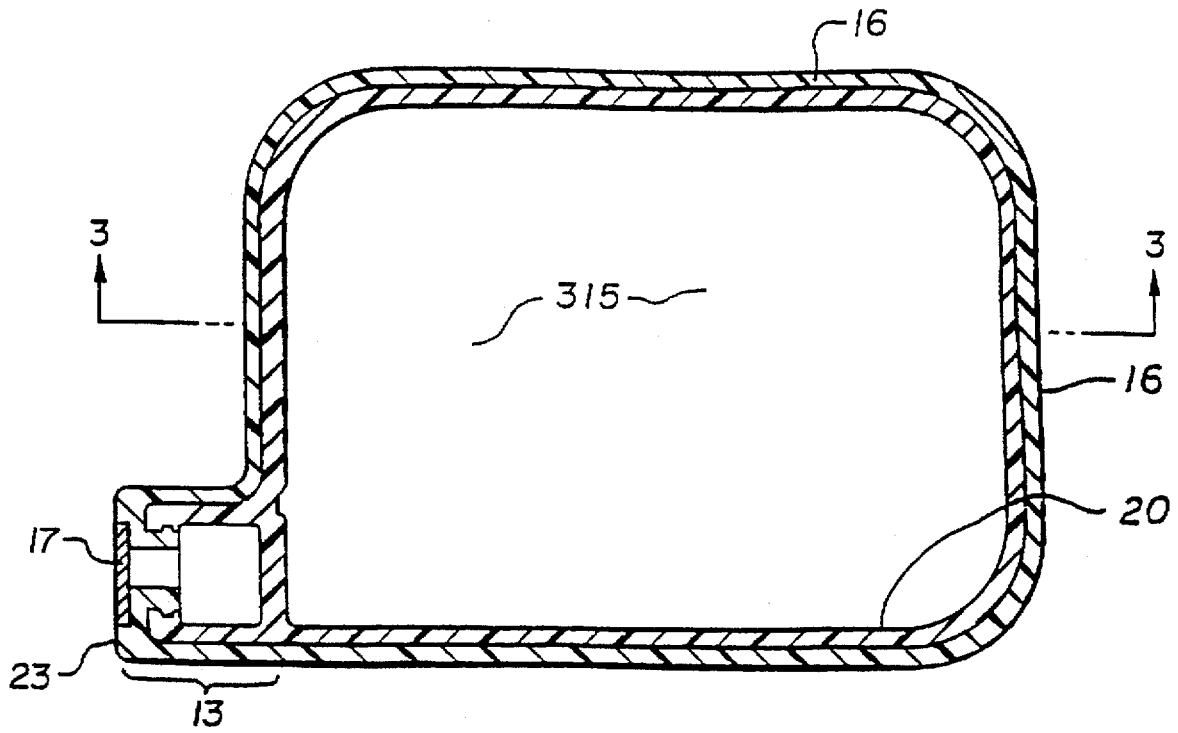
FIG. 2 is a sectional view taken along the line 2—2 of FIG. 3, with the spring assembly not shown.
Figure 3:
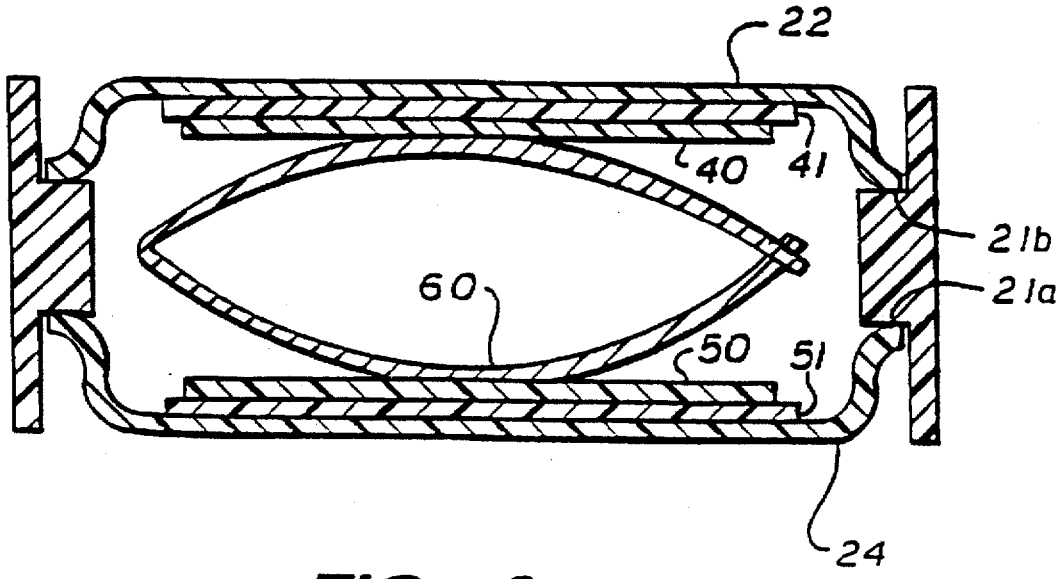
FIG. 3 is a cross-sectional view of the cartridge of FIG. 2, with partial enlargements at the sections shown thereon.

FIG. 2 illustrates a partially assembled ink cartridge embodying the invention, including an external pen case comprising a composite frame structure 16, 20 and a pair of side covers 12, 14. The frame structure defines an open area 315 for the ink reservoir. The pen snout 13 is formed at one corner of the cartridge, and a printhead 17 is attached at an end 21 of the snout 13. TIJ printheads are well known in the art, and include a plurality of orifice nozzles disposed in a printhead plane. In this exemplary embodiment, the nozzles eject ink droplets in a direction generally normal to the printhead plane. The cartridge and carriage are provided with electrical wiring elements (not shown) to connect the print head 17 to the printer controller to control the operation of the print head, as is well known in the art.

Figure 6:
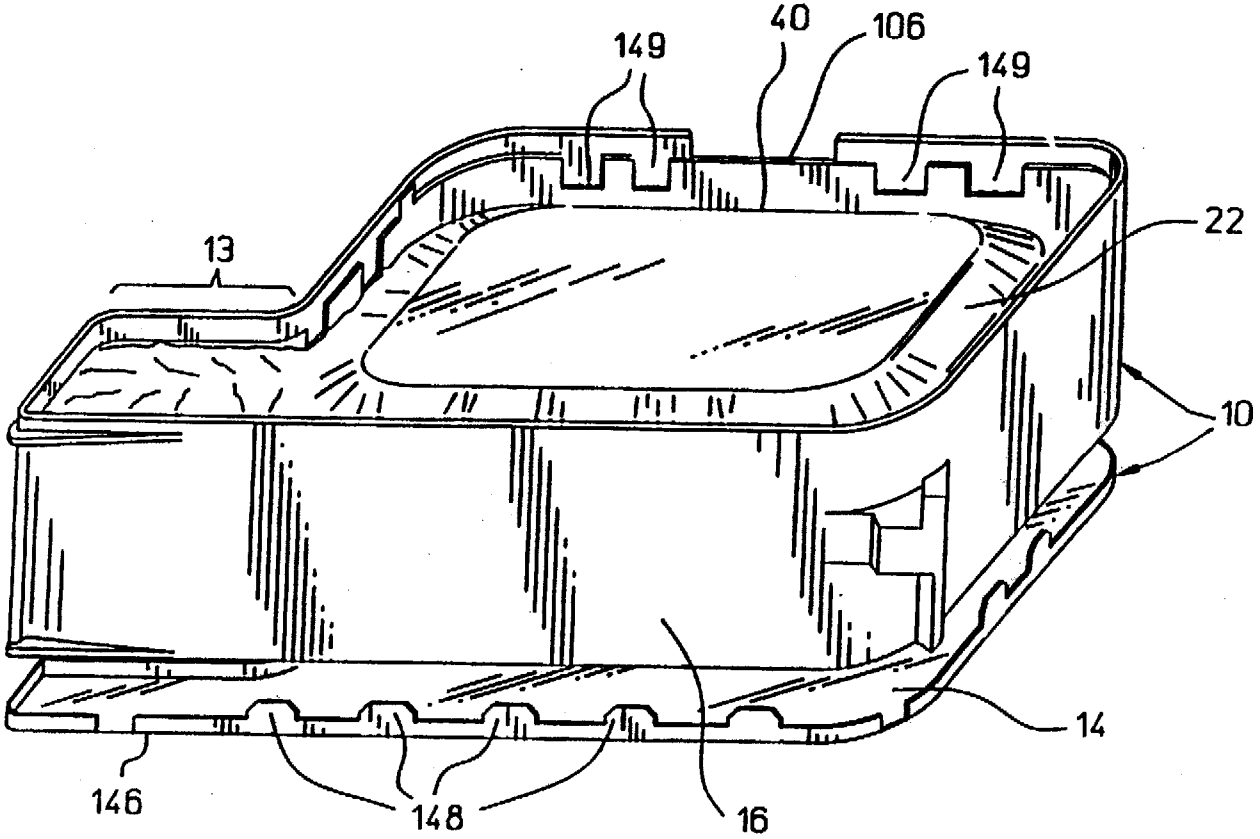
FIG. 6 is a closeup perspective view of the cartridge of FIG. 4 after assembly, with sidecovers removed.

The pressure regulator 30 is centrally positioned in the open area 315 of the inner peripheral frame 20 and the two flexible ink reservoir sidewalls 22, 24 are heat bonded or cemented at their peripheral edges to the outer edge walls 21 of the inner peripheral frame 20, with care being taken to maintain the central positioning at all times of the regulator in the inner periphery frame between the flexible sidewalls. The reservoir sidewalls may then be securely affixed to the sideplates, preferably by heat bonding in the area shown as 144. This heat sealing has the primary purpose of preventing relative motion between the pressure regulator 30 and the flexible sidewalls, as well as preventing direct contact of the metal sideplates 40, 50 with the relatively delicate reservoir sidewalls to prevent the edges of the sideplates from cutting or puncturing the sidewalls. As best shown in FIG. 6, each cover plate 146 is affixed to the outer peripheral frame through matching tabs 148 and slot 149.

The material used for reservoir sidewalls should be flexible, relatively puncture resistance, impermeable to moisture and chemically compatible and non-reactive with the ink contained therein to prevent leakage or migration of the ink out of the reservoir, and impermeable to external contaminants such as air, dust, liquids and the like.

The reservoir is filled with ink via port 122 which is subsequently plugged for shipment. The required means which fire the ink droplets through the orifices on the printhead is well known in the art and cause progressive collapse of the spring reservoir such that its sidewalls both retract inwardly as the ink volume in the reservoir is decreased.

Figure 4:
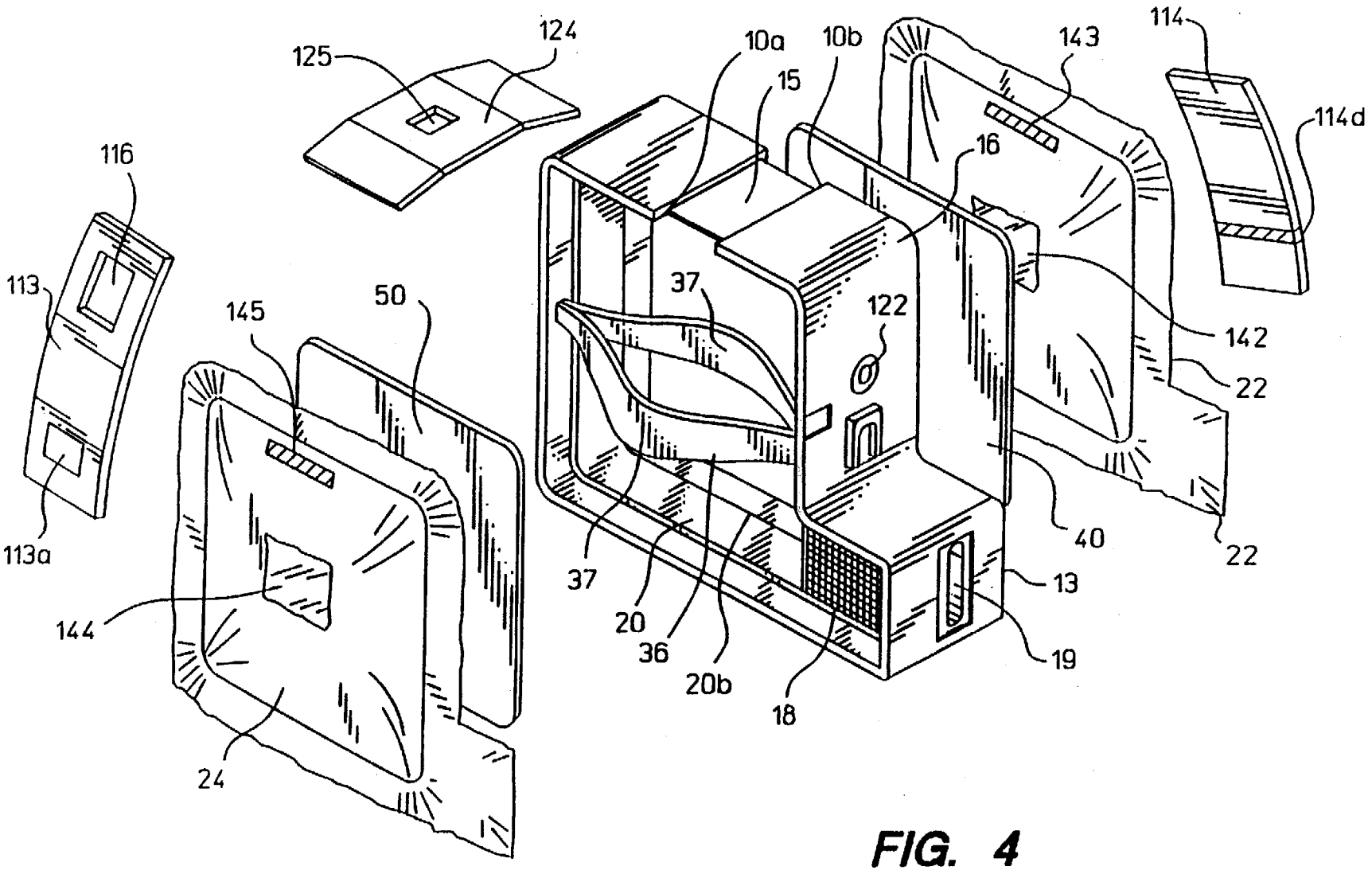
FIG. 4 is an exploded perspective view of another presently preferred embodiment of the invention after assembly.
Figure 5:
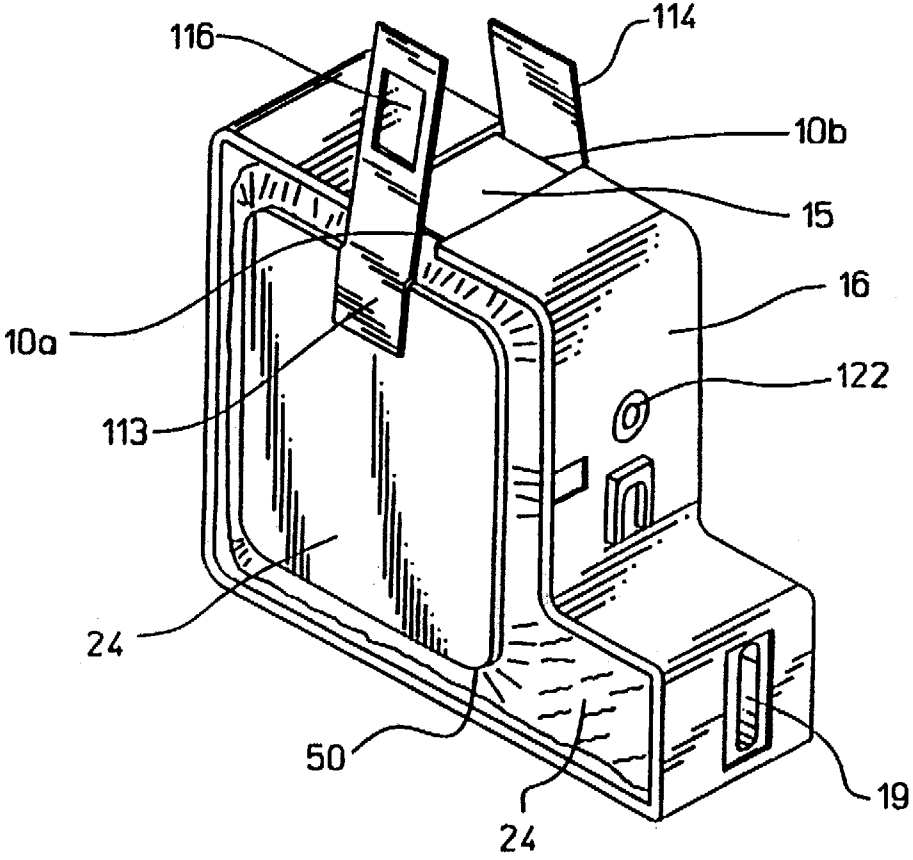
FIG. 5 is a perspective view of the cartridge of FIG. 4 after assembly, with sidecovers not shown.

Referring to FIGS. 4, 5 and 6, peripheral outer frame is provided with a pair of spaced parallel slots 10*a* and 10*b* on opposite sides of reduced thickness channel 15. Cover plates include additional centrally located slots (not shown) aligned with slots 10*a*, 10*b*, respectively, to provide a passageway for ink level indicator strips 113 and 114 which are cemented to heat sealed to opposite reservoir sidewalls 124, 122, respectively. The joinder areas are shown as areas 142, 144 in FIG. 4. A window device 124 having a stationary viewing window 125 therein is placed over and aligned with the reduced thickness channel 15 to provide a passageway for movement of the indicator strips 113, 114.

Figure 7A:
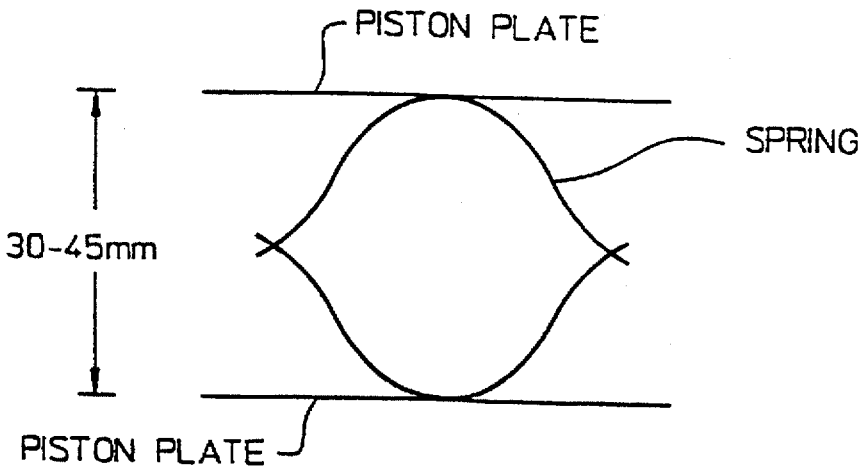
FIG. 7 schematically shows three stages of compression for the spring assembly of the present invention.
Figure 7B:
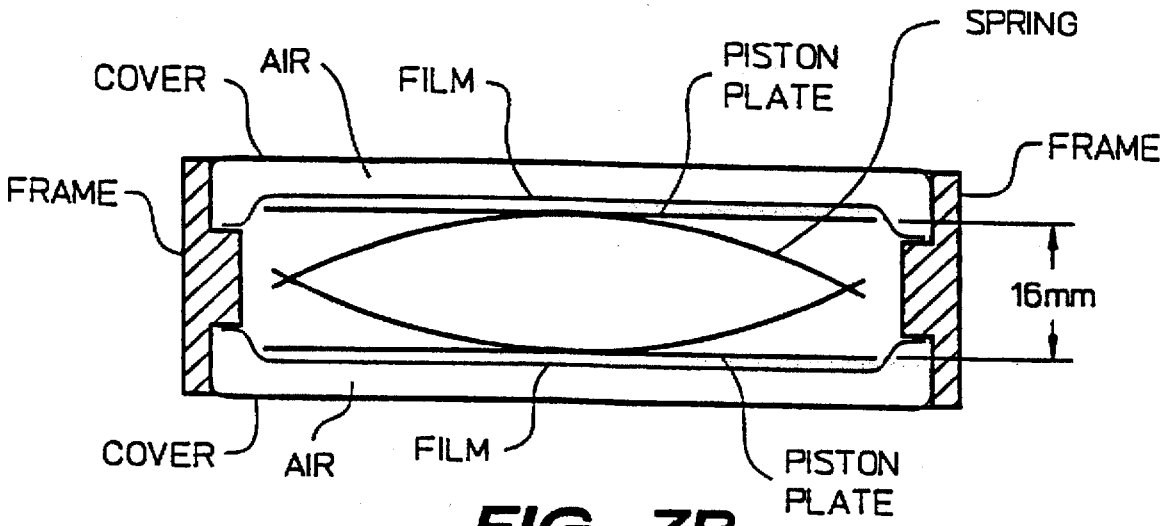
Figure 7C:
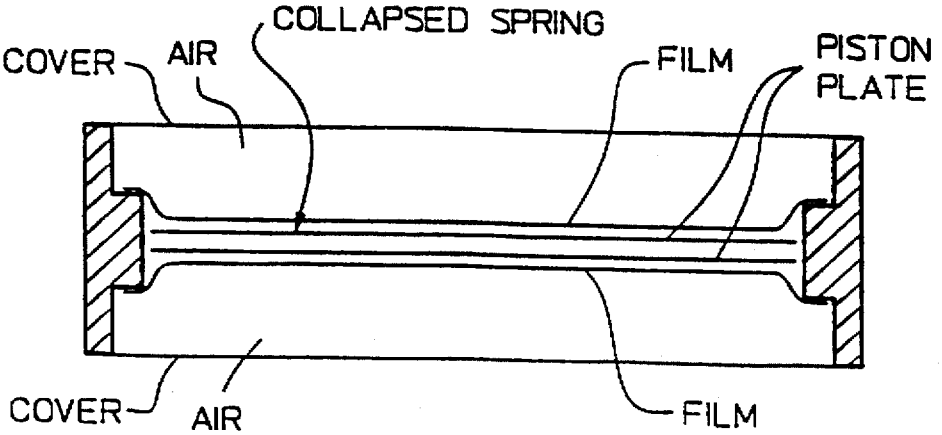

The schematic drawing of FIG. 7 shows how the spring assembly is preloaded inside the cartridge in order to optimize the range of negative pressure exerted by the spring during depletion of the ink from the reservoir. The actual negative pressure required of the spring is based on various factors, including the nozzle orifice architecture, the geometry of the cartridge (including the outer expansion limits of the reservoir as determined by the thickness of the cartridge) , and the static ink head in the reservoir as determined by the horizontal/vertical orientation of the cartridge when mounted in printing position in the carriage. In this regard it is important to emphasize that when ink is supplied to the ink reservoir through inlet hole 122, the spring force exerted against the flexible walls of the ink reservoir must be calibrated to provide sufficient back-pressure (i.e., negative pressure) to prevent any undesirable leakage of the ink such as drooling through the printhead during cartridge storage, during cartridge installation on the carriage, or during operation on the carriage. Thus, the flexible walls should not contact the cover plates of the casing or the rigid frame member after the filling operation is completed, as best shown in the "pre-loaded" middle drawing of FIG. 7.

Figure 9:
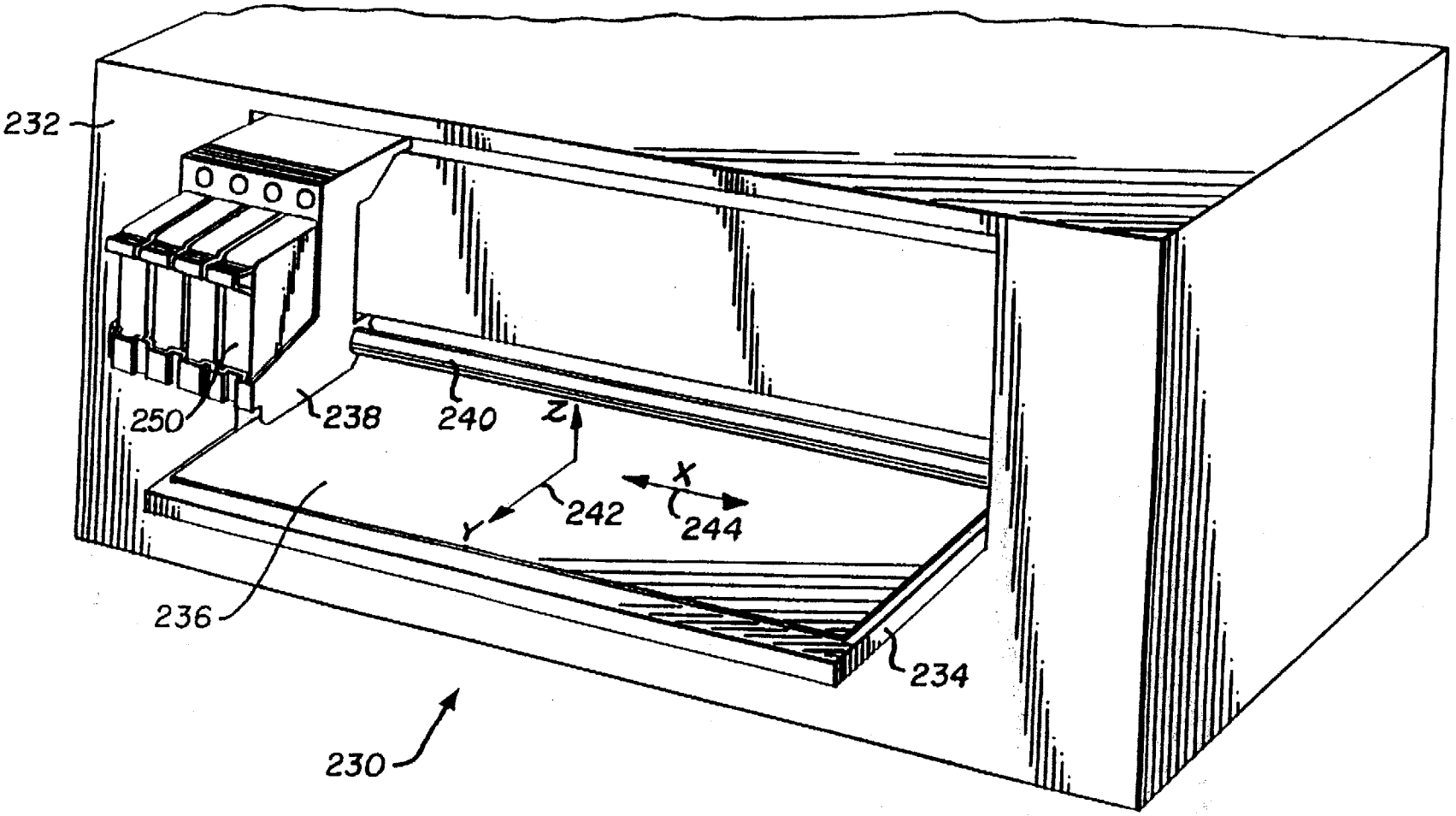
FIG. 9 is a perspective view showing multiple cartridges of the present invention mounted for use in a printer/plotter.

FIG. 9 illustrates a preferred embodiment of a TIJ printer incorporating a cartridge mounted in an upright position with the longest dimension of the cartridge in the Z axis, the intermediate dimension of the cartridge in the Y axis, and the thinnest dimension of the cartridge in the X axis. The printer includes a housing 232 which supports various elements including a platen 234 which supports a print medium 236 such as a sheet of paper. The printer includes a pen carriage 238 which is driven along a support shaft 240 to eject drops of ink from the pens 250 onto the print medium. As is well known in the art, the printer further includes media advancement mechanisms not shown to advance the medium in the Y direction arrow 242 along the medium advancement axis to position the medium for the next successive transverse swath carried out by the carriage 238 along the scan axis 244. According to one aspect of the invention, the carriage 238 holds a plurality of thin pens 250, and is relatively narrow due to the thinness of the pens along the X direction 244 of carriage movement. As a result, the required width of the printer 230 can also be relatively smaller than in prior designs. Further, the depth dimension of the pen is smaller than the height dimension, thereby minimizing the pen footprint while providing a high volume pen. This permits further a reduction in the printer footprint size.

Figure 8:
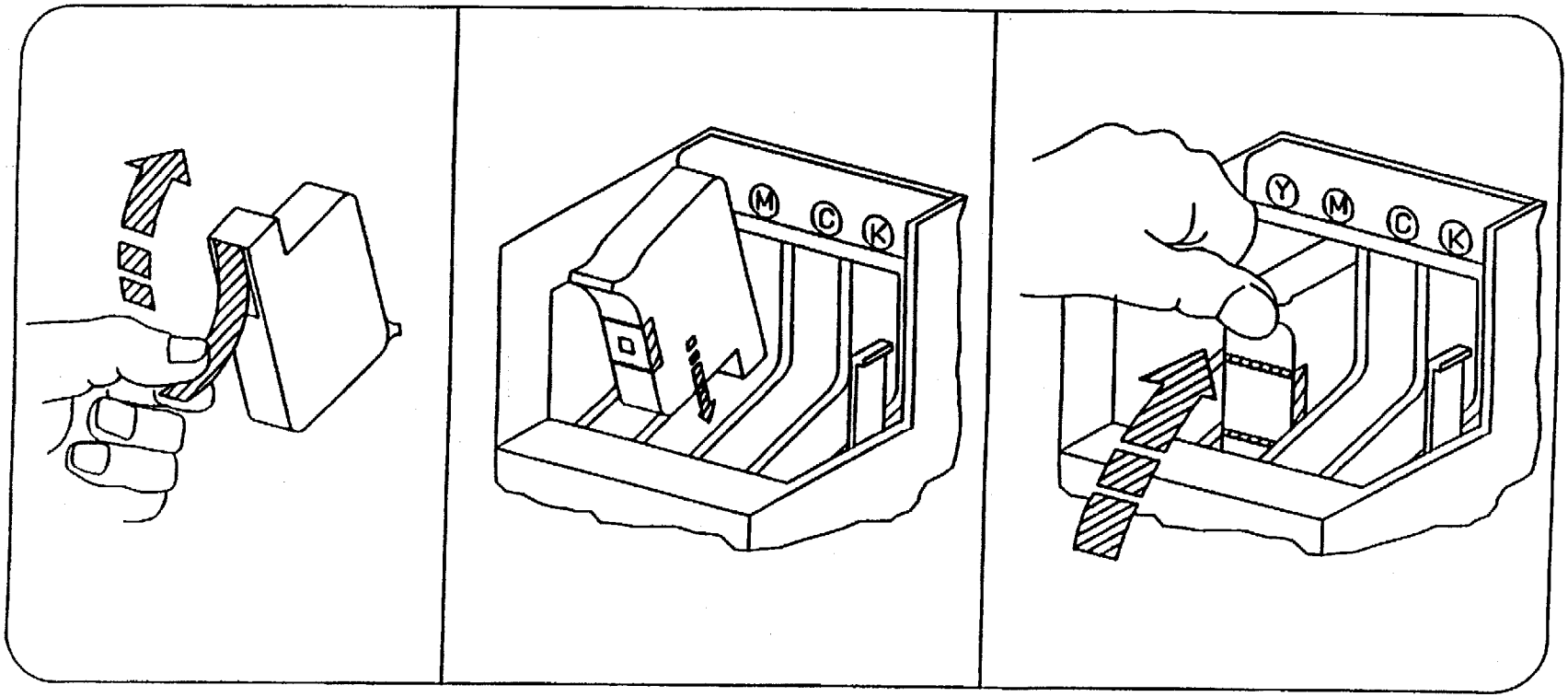
FIG. 8 shows three steps for installing the aforesaid cartridge in a multi-pen carriage.

In the preferred embodiment, the carriage 238 includes compartments adapted to carry four pens, each of a different color, as for example black, cyan, magenta and yellow. The pens are secured in a closely packed arrangement and may be selectively removed from the carriage for replacement with a fresh pen (see FIG. 8). The printheads of the pens are exposed through openings in the pen compartments facing the print medium.

While the aforementioned exemplary embodiments are TIJ cartridges, the invention is adaptable for use with other print cartridges which incorporate an ink reservoir as part of the cartridge. Similarly, the invention is not limited to a two-material frame but would be adaptable to any unitary or composite frame member such that a flexible membrane could be heat staked, glued, bonded, or sealed by compression or the like to the frame.

According to another aspect of the invention, an off-axis auxiliary ink reservoir is connected to a spring bag primary ink reservoir, thus increasing the amount of unattended printing possible with the system. This aspect is particularly well suited to solution of problems associated with large format printing (LFP). The off-axis auxiliary reservoir provides the LFP user with an increase in printer unattendedness and decreases the degree of user intervention. This is accomplished while maintaining print quality over a large range of ink usage.

An exemplary system includes an ink-jet cartridge with a primary spring bag reservoir, ink supply tubing and an auxiliary ink reservoir connected to the primary reservoir through the tubing. The primary reservoir is continuously refilled with ink using a combination of primary reservoir back pressure (vacuum) and supply bag positive pressure to drive the flow of ink from the auxiliary reservoir to the primary reservoir. The inner diameter of the tubing is sufficient to supply ink under heavy printing loads to maintain the ink supply in the primary spring-bag reservoir; the system does not rely on capillary flow through the tubing. Due to the sensitivity of the print quality on cartridge back-pressure, the auxiliary reservoir is located at a vertical position that establishes an ink pressure head at the tubing system outlet that prevents both drooling of ink at the print head nozzles and starvation of ink at the nozzles, and also ensures a continuous flow of ink from the auxiliary reservoir to the primary reservoir.

The tubing can be connected to the primary reservoir through the ink fill port, e.g., port 122 (FIG. 4) through which the primary reservoir is typically initially filled with ink, as described in commonly assigned, co-pending application Ser. No. 08/455,478, filed concurrently herewith, INK-JET SWATH PRINTER WITH AUXILIARY INK RESERVOIR, J. H. Bohorquez et al, Attorney Docket Number 10950575-1, the entire contents of which are incorporated herein by this reference. Alternatively, the tubing can be connected to the primary reservoir through a second replenishment port extending through the cartridge frame, e.g., in the corner handle area as described more fully below.

The print quality of a spring-bag ink-jet cartridge is known to depend on back-pressure. Since this is generally held constant in accordance with one aspect of the invention while the auxiliary reservoir contains ink, print quality is regulated to some extent through an increased time period or quantity of printing. The back pressure in the primary reservoir is highly dependent on the volume of ink in the primary reservoir, and thus the amount of ink flowing from the auxiliary reservoir to the primary reservoir becomes critical. Essentially, the desired amount of ink in the primary reservoir dictates where the auxiliary reservoir should be placed in reference to the height below the cartridge print head nozzles. Good print quality is obtained when the back pressure in the cartridge is maintained within a specific range. If the auxiliary reservoir is placed too high with respect to the nozzles, too much ink may flow into the primary reservoir, which causes a decrease in the back pressure and may allow the cartridge to drool or leak ink through the nozzles. If the auxiliary reservoir is placed too low in relation to the elevation of the nozzles, a reverse flow of ink may result which causes ink to flow from the primary reservoir to the auxiliary reservoir, resulting in increased back pressure and nozzle starvation. For exemplary spring-bag cartridge reservoirs and ink-jet printheads, a typical range of back pressures is 2 to 10 inches of water, with a narrower range of 3 to 7 inches of water desirable. The range of back pressures for which a given cartridge will operate properly is dependent on the spring rate and print head type.

In accordance with another aspect of the invention, the height of the auxiliary reservoir in relation to that of the print head nozzles is regulated using a spring mechanism that continually provides an upward force on the auxiliary reservoir. As the ink is drained from the auxiliary reservoir into the primary reservoir, the spring force acting on the auxiliary reservoir causes the auxiliary reservoir to rise relative to its initial position before ink is drained. As a result, the system provides a means for maintaining a relative constant amount of energy (pressure head and elevation head) at the auxiliary reservoir. The back pressure in the primary reservoir is highly dependent on the amount of ink in the reservoir. When a small amount of ink is expelled through the print head nozzles, an increase in back pressure is realized in the primary reservoir. This results in an increased ink flow rate from the auxiliary reservoir to the primary reservoir until the volume of ink within the primary reservoir is such that the back pressure is reduced to a point where the ink flow rate goes to zero. This aspect of the invention creates a process by which the amount of ink within the primary reservoir remains constant as long as there is ink in the auxiliary reservoir. Additionally, the increasing elevation of the auxiliary reservoir as it is drained provides a method by which the weight of the bag, and hence the amount of ink within it, may be monitored electronically using a potentiometer or Linear Variable Differential Transducer, or other displacement transducer.

Figure 10:
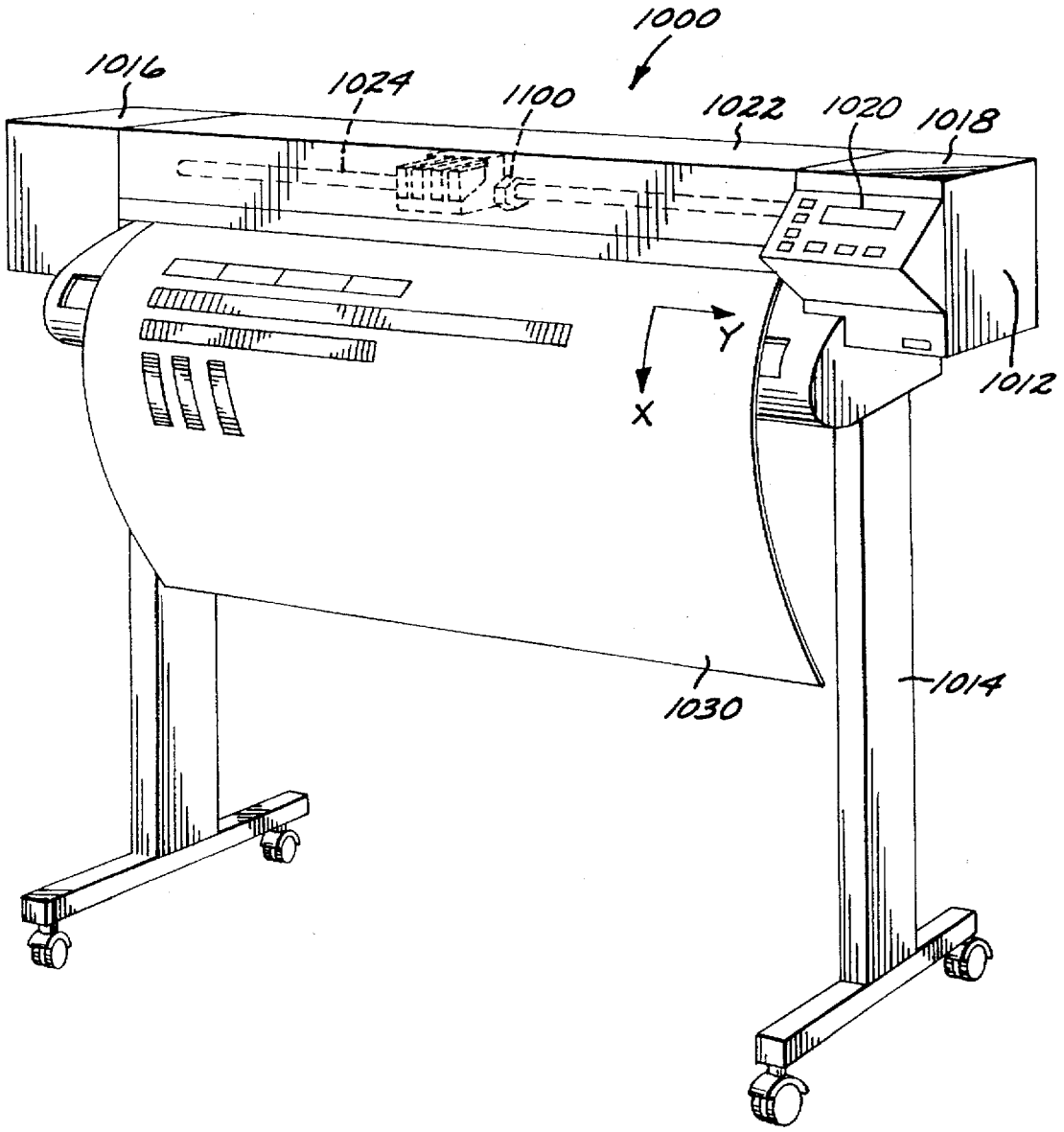
FIG. 10 is a perspective view of a large scale printer/plotter embodying another aspect of the invention.

An exemplary embodiment employing this aspect of the invention is illustrated in FIGS. 10–25. This embodiment is a swath plotter/printer 1000 for LFP applications. FIG. 10 is a perspective view of the thermal inkjet large format printer/plotter 1000. The printer 1000 includes a housing 1012 mounted on a stand 1014 with left and right drive mechanism enclosures 1016 and 1018, and a control panel 1020. A carriage assembly 1100 is adapted for reciprocal motion along a carriage bar 1024, both shown in phantom under a cover 1022. A print medium 1030 such as paper is positioned along a vertical or media axis by a media axis drive mechanism (not shown). As is common in the art, the media axis is denoted as the 'x' axis and the carriage scan axis is denoted as the 'y' axis.

Figure 11:
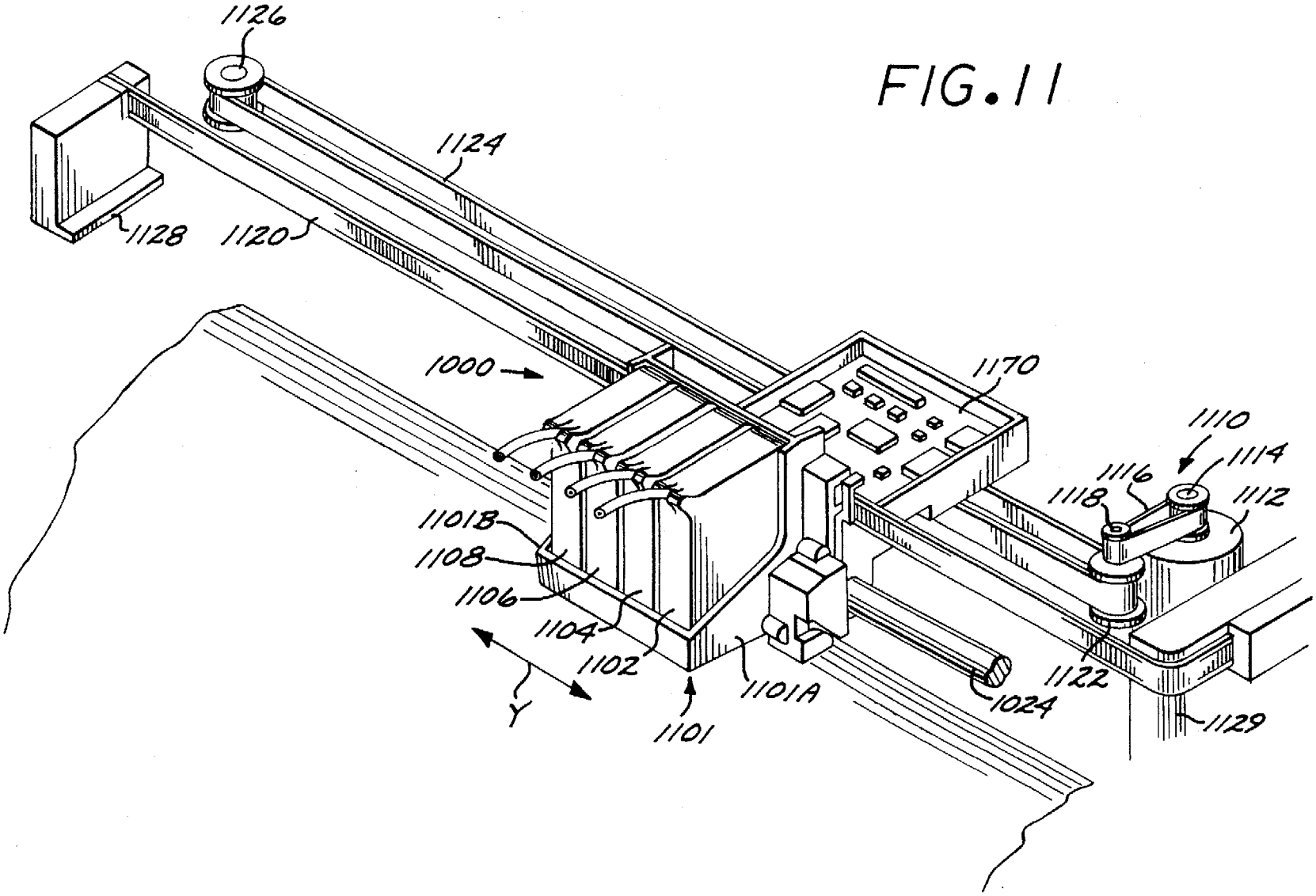
FIG. 11 is an isometric view of the carriage assembly of the printer/plotter of FIG. 10.

As shown in FIG. 11, the position of the carriage assembly 1100 in a horizontal or carriage scan axis is determined by a carriage positioning mechanism 1110 with respect to an encoder strip 1120. The carriage positioning mechanism 1110 includes a carriage position motor 1112 which has a shaft 1114 extending therefrom through which the motor drives a small belt 1116. Through the small belt 1116, the carriage position motor 1112 drives an idler 1122 via the shaft 1118. In turn, the idler 1122 drives a belt 1124 which is secured by a second idler 1126. The belt 1124 is attached to the carriage 1100 and adapted to slide therethrough.

The position of the carriage assembly in the scan axis is determined precisely by the use of the code strip 1120. The code strip 1120 is secured by a first stanchion 1128 on one end and a second stanchion 1129 on the other end. An optical reader (not shown) is disposed on the carriage assembly and provides carriage position signals which are utilized by the invention to achieve optimal image registration in the manner described below.

The media and carriage position information is provided to a processor on a circuit board 1170 disposed on the carriage assembly 1100 as the carriage 1100 moves back and forth. The processor is connected to a printer controller secured within the printer housing via a flexible wiring harness arranged in a service loop to accommodate the movement of the carriage along the swath axis.

Figure 12:
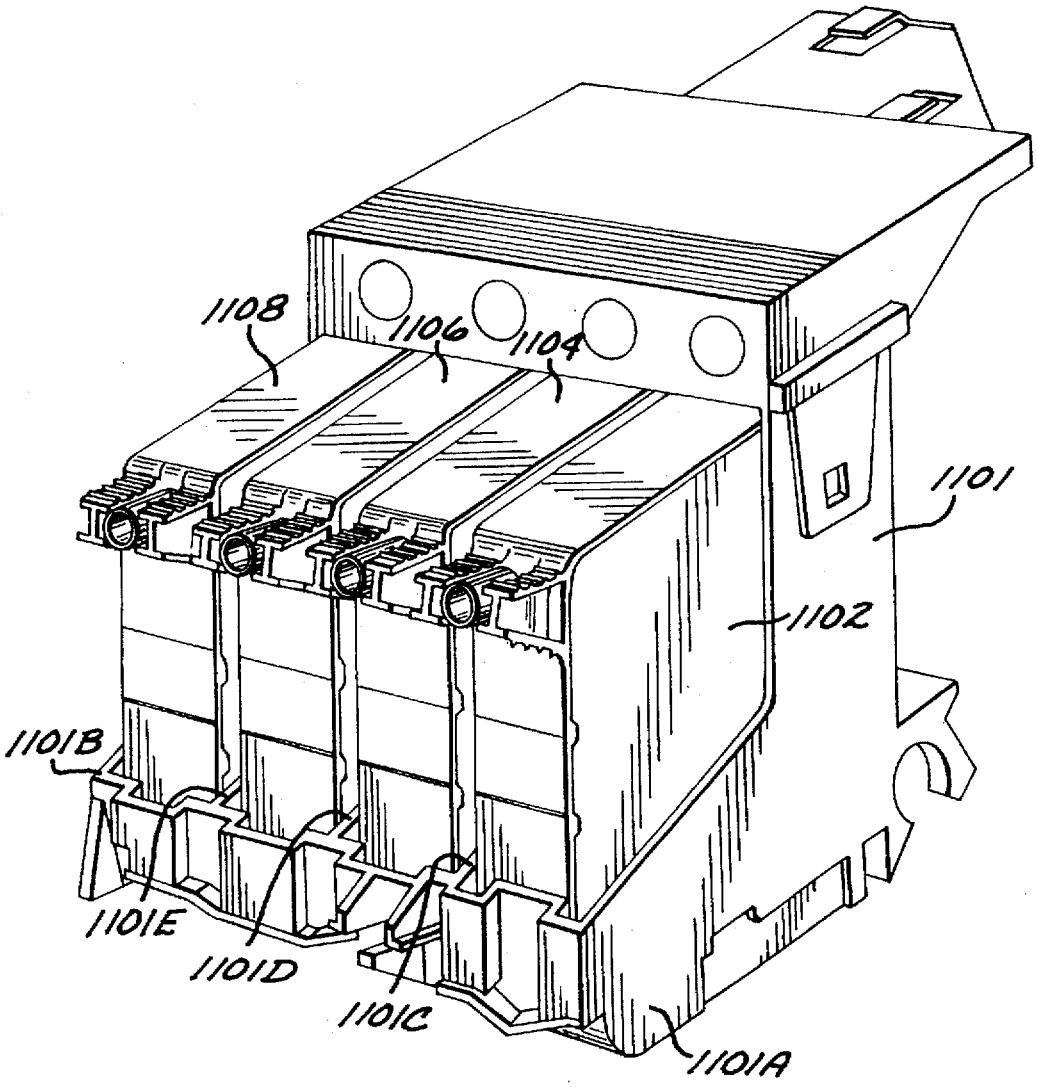
FIG. 12 is a isolated perspective view showing further details of the carriage assembly of FIG. 11.

Referring to FIGS. 10–12, the printer 1000 has four ink-jet cartridges 1102, 1104, 1106, and 1108 that store ink of different colors, e.g., black, yellow, magenta and cyan ink, respectively, in internal spring-bag reservoirs. As the carriage assembly 1100 translates relative to the medium 1030 along the x and y axes, selected nozzles in the ink-jet cartridges 102, 104, 106, and 108 are activated and ink is applied to the medium 1030. The different ink colors from the ink-jet printheads are mixed to obtain a full spectrum of color.

The carriage assembly 1100 positions the ink-jet cartridges 1102, 1104, 1106 and 1108, and holds the circuitry required for interface to the heater circuits in the ink-jet cartridges. The carriage assembly 1100 includes a carriage 1101 adapted for the reciprocal motion on a front slider (not shown) and a rear slider 1024. The cartridges are secured in a closely packed arrangement, and may each be selectively removed from the carriage for replacement with a fresh pen. The carriage 1001 includes a pair of opposed side walls 1101A and 1101B, and spaced short interior walls 1101C, 1001D and 1101E, which define cartridge compartments. The carriage walls are fabricated of a rigid engineering plastic. The print heads of the cartridges are exposed through openings in the cartridge compartments facing the print medium.

As mentioned above, full color printing and plotting requires that the colors from the individual cartridges be applied to the media. This causes depletion of ink from the internal cartridge reservoirs.

Figure 13:
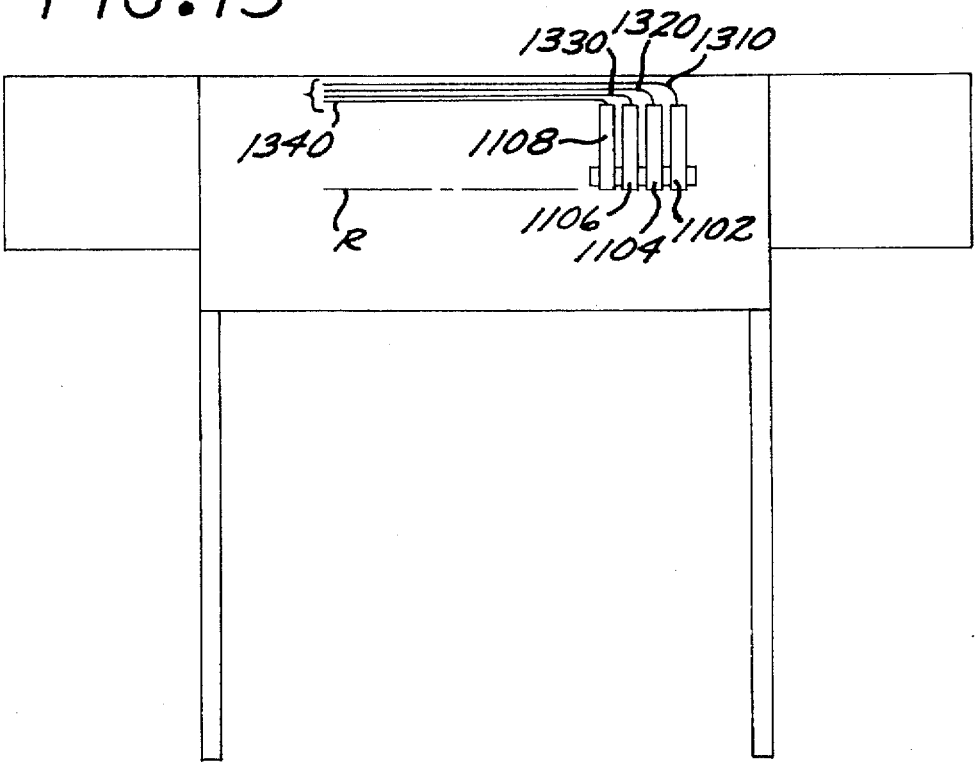
FIG. 13 is a simplified front elevation view of the printer/plotter of FIG. 10.
Figure 14:
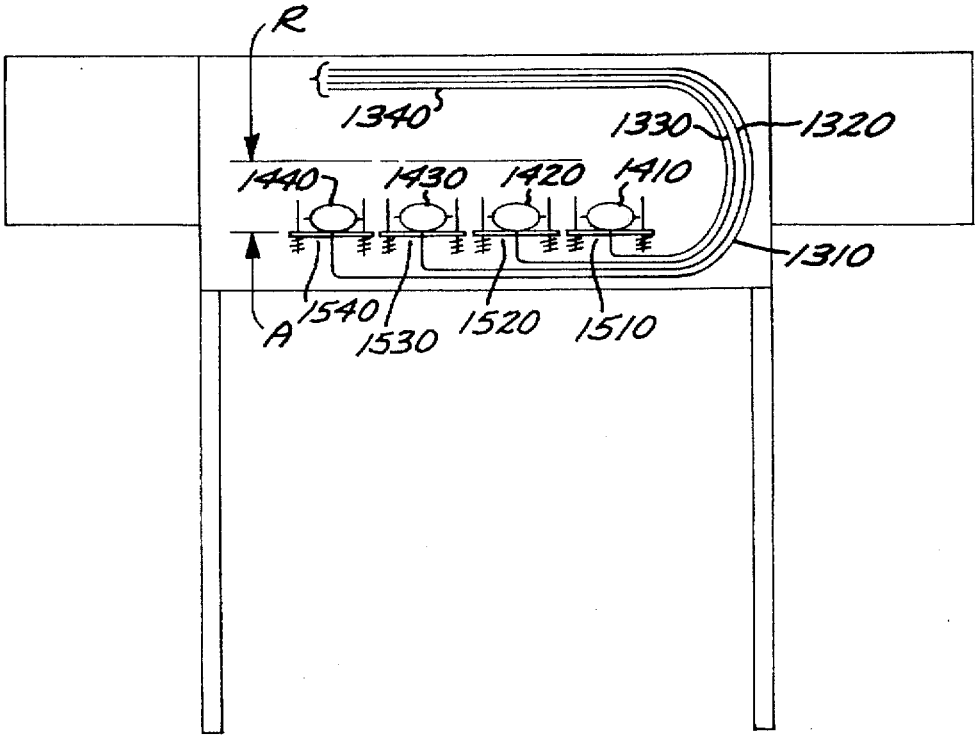
FIG. 14 is a simplified rear elevation view of the printer/plotter of FIG. 10.

To provide higher ink volume capacity in accordance with the invention, an auxiliary reservoir is connected via a tube to each spring bag cartridge internal reservoir. Thus, as shown in FIGS. 13–14, auxiliary reservoir 1410 is connected to cartridge 1102 via tube 1310. Auxiliary reservoir 1420 is connected to cartridge 1104 via tube 1320. Auxiliary reservoir 1430 is connected to cartridge 1106 via tube 1330. Auxiliary reservoir 1440 is connected to cartridge 1108 via tube 1340. The connection tubes can be carried with a length of the flexible electrical wiring harness or service loop used to provide electrical connections to the processor on the circuit board 1170, thereby accommodating the movement of the carriage along the swath axis. For example, a length of cable chain can be used to carry the electrical service loop and the connection tubes. The cable chain is flexible, with chain links connected together with pivot pins, and the service loop and tubes can be connected at various points along the cable chain by wire ties, or secured within a channel defined by the cable chain. One end of the cable chain is connected to the carriage; the other end is secured to the printer body. The flexibility of the chain allows the chain with the piggy-backed service loop and tubes to follow in a controlled fashion the movement of the carriage. Suitable cable chains are available, e.g., the cable products marketed by Igus, Inc. East Providence, R.I., as the Igus Energy Chain Series 07 products.

The four auxiliary reservoirs 1410–1440 are held on platforms 1510, 1520, 1530 and 1540 suspended from the plotter body adjacent to the pen carriage, there being relative motion between the auxiliary reservoirs and the pen carriage, as well as between the auxiliary reservoirs and the print medium. The auxiliary reservoirs are connected via flexible tubes to the respective internal reservoirs of the spring bag pens. The tubes are secured with the electrical control ribbon connector which connects to the pens to drive the ink-jet printheads.

FIG. 13 is a simplified schematic front view of the printer/plotter 1000, showing the tubes 1310, 1320, 1330 and 1340 attached to the respective cartridges 1102, 1104, 1106 and 1108. These tubes lead to the respective auxiliary reservoirs 1410, 1420, 1430 and 1440, as shown in the rear view of FIG. 14. The auxiliary reservoirs are flat, high capacity bags. Each set comprising a spring-bag cartridge reservoir, tube and auxiliary reservoir are connected together to form a sealed continuous ink replenishment system.

Figure 15A:
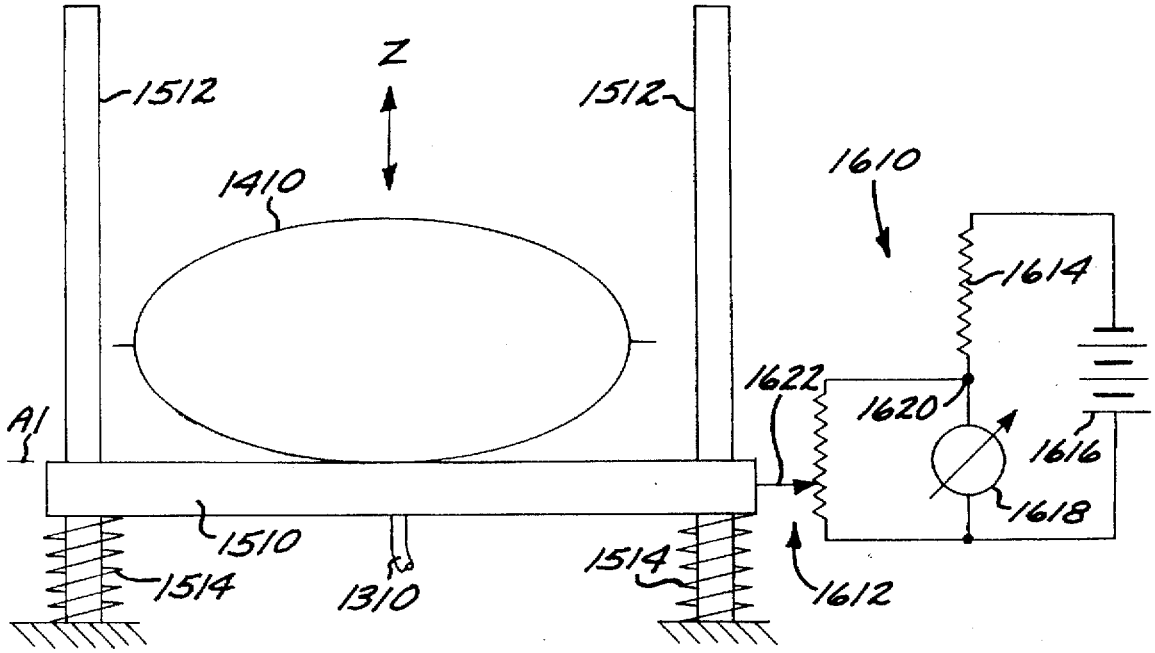
FIG. 15A is a simplified schematic illustration of a spring-loaded platform for an auxiliary reservoir which is filled with ink, together with an ink level detecting circuit.
Figure 15B:
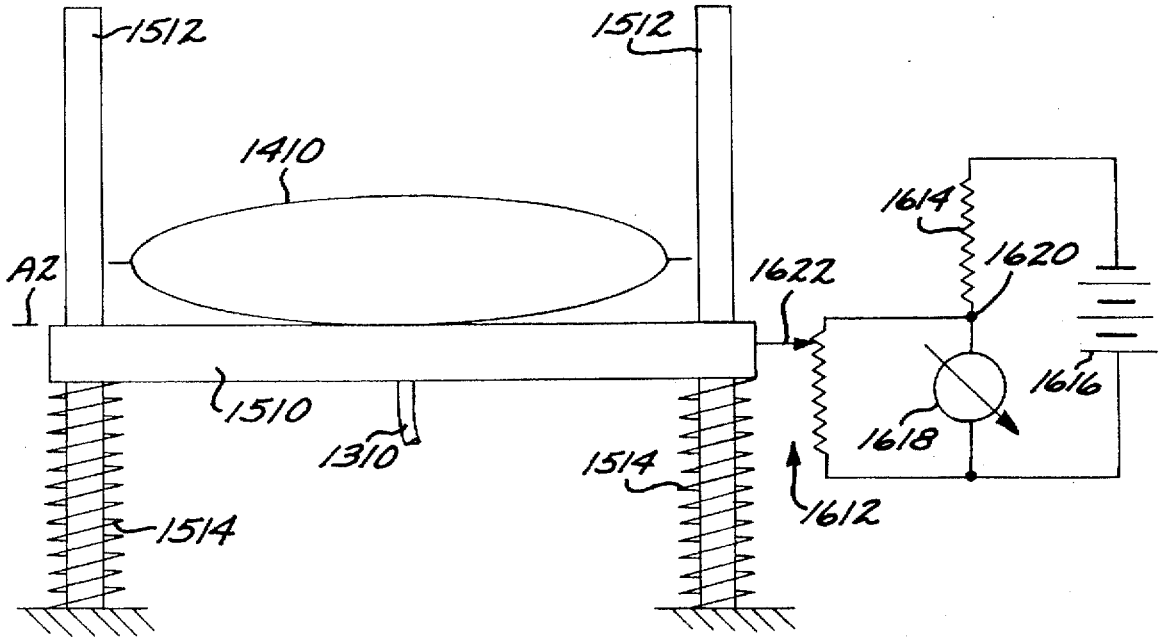
FIG. 15B is a view similar to FIG. 15A, with the ink partially drained from the auxiliary reservoir.

The auxiliary reservoirs 1410, 1420, 1430 and 1440 are each supported on spring-loaded platforms 1510, 1520, 1530 and 1540 (FIG. 14). FIGS. 15A and 15B illustrate platform 1510 and auxiliary reservoir 1410, and the height regulation features thereof; the other platforms are identical to platform 1510. The platform 1510 is supported by coil springs 1514 and slides up/down on posts 1512. The height position of the platform in the Z direction will then depend on the weight of the auxiliary reservoir bag 1410. For a reservoir which has been filled with ink, as represented in FIG. 15A, the platform position will stabilize at a relatively low equilibrium position, indicated as A1. As ink is drawn from the bag 1410 to replenish the spring bag reservoir in the cartridge 1102, the bag 1410 becomes lighter, and the spring force acting on the platform causes it to rise in height relative to its starting position A. FIG. 15B represents the partially emptied bag, with the platform at a height A2.

As a result of the auxiliary reservoir 1410 connected in a closed fluid path to the primary spring bag reservoir within the cartridge, a relatively constant amount of energy (pressure head and elevation head) is maintained. The back-pressure in the cartridge primary reservoir is primarily regulated by the amount of ink contained within it. When a small amount of ink is expelled through the cartridge print head nozzles during printing operations, an increase in cartridge back-pressure is realized. This in turn results in an increase flow rate from the auxiliary reservoir to the primary reservoir until the volume of ink within the primary reservoir is such that back-pressure is reduced to an equilibrium point where the ink flow rate from the auxiliary reservoir goes to zero. Thus, the invention provides a technique by which the amount of ink within the primary reservoir remains constant as long as there is ink in the auxiliary reservoir.

While an arrangement employing coil springs has been disclosed, other types of position biasing apparatus can be employed, including leaf springs and the like.

There is a narrow range of cartridge/auxiliary bag height differentials that will work correctly; too small a height differential and the cartridge reservoir will overfill and drool ink from the print head due to too low a back-pressure. Too great a height differential and the cartridge reservoir will underfill and will not be able to print due to too high a back-pressure. It is desired that the system be set up so that the spring-bag plates never touch the outer frame covers due to overfilling, and the plates do not collapse completely until the auxiliary reservoir ink supply has been deleted.

This height difference can be determined empirically by testing a statistically significant population of cartridges. The ideal height differential is one which will not cause a statistically "worst case" cartridge to drool or puddle, i.e., a cartridge having a spring-bag reservoir with the highest back pressure at which the system will be designed to operate. These cartridges have higher than normal back pressure, and as such, may cause ink to flow at height differences at which other cartridges may not experience ink flow. To ensure these "worst case" cartridges do not puddle or drool, the height difference, i.e., the height differential between the higher cartridge and lower auxiliary reservoir, is increased from a nominal distance to give some margin. The nominal distance is based on average back pressures for a given "filled" cartridge, say 40 cc of ink which may correspond to 3 inches of water back pressure in an exemplary cartridge.

In one exemplary embodiment, the cartridge-bag system will work well with the bag's upper surface between one and four inches below the cartridge nozzle plate. The system can accommodate a moderate degree of air, though the tube from the cartridge to the auxiliary bag should be kept below the top of the cartridge to avoid the formation of an air lock.

Figure 20:
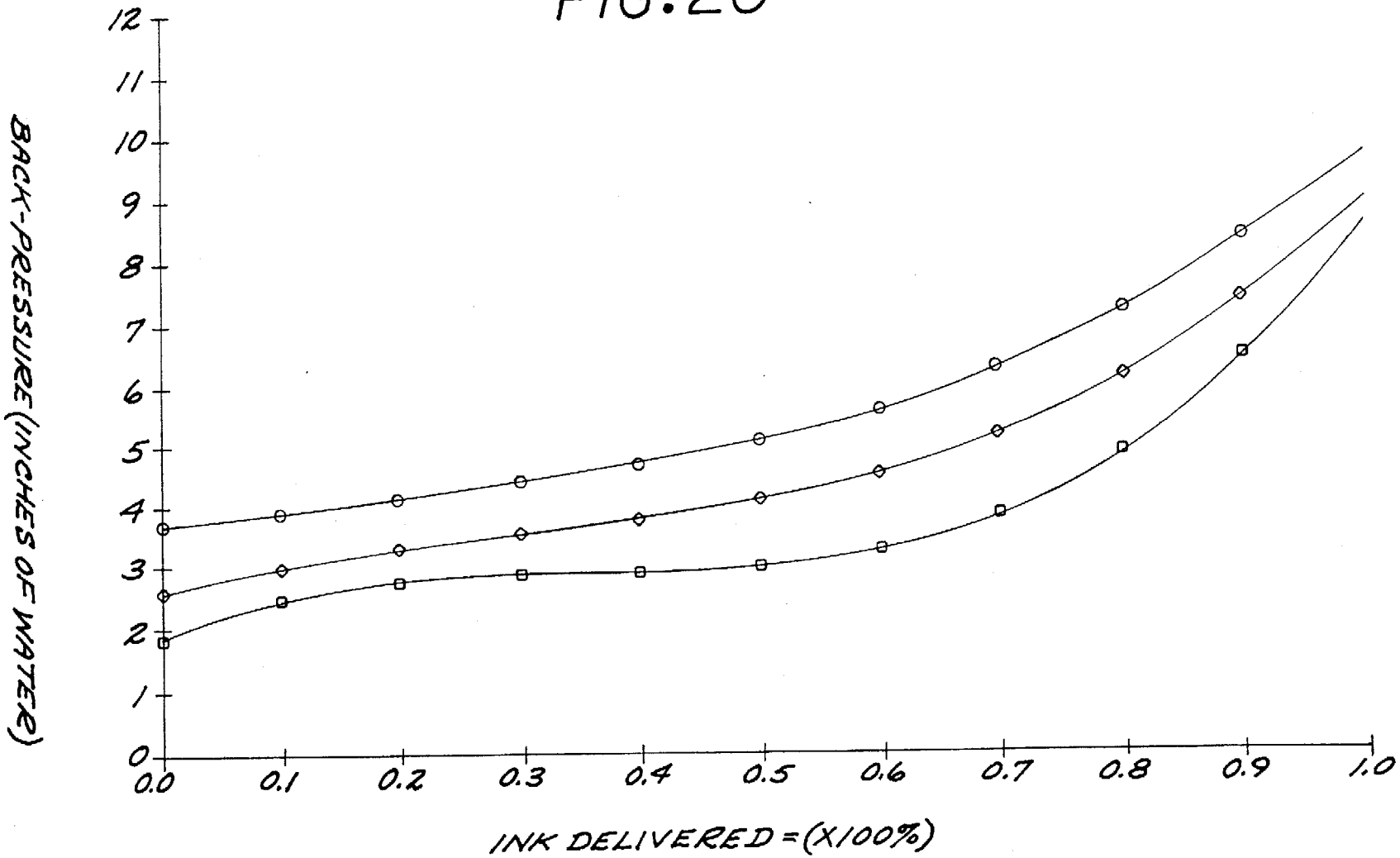
FIG. 20 is a plot of data showing the ink back-pressure as a function of ink delivered from a spring-bag cartridge, for various spring-bag spring rates.

FIG. 20 illustrates exemplary closed spring-bag reservoir back pressures for three different reservoir spring stiffnesses, as a function of the percentage of ink volume delivered from the internal spring bag reservoir (not connected to an auxiliary reservoir). The higher the spring stiffness, the higher will be the back pressure. FIG. 20 shows that as ink is delivered from the cartridge reservoir, the back pressure increases. These are average back pressures, and provide a starting point for auxiliary reservoir location.

FIGS. 15A and 15B illustrate a circuit 1610 for monitoring electronically the weight of the auxiliary reservoir and hence the volume of ink within the auxiliary reservoir 1410. This exemplary implementation includes a potentiometer 1612 and a fixed resistance 1614 connected in series to form a voltage divider circuit, with a constant voltage source 1616 supplying a reference voltage to the voltage divider circuit. An ink level meter 1620 provides an indication of the voltage at node 1620. The potentiometer wiper 1622 is coupled to the platform 1510 so that as the platform level changes, the wiper is moved, changing the resistance through the potentiometer and hence the voltage at the node 1620. The indication provided by the meter 1618 can be calibrated to provide an accurate indication of the platform level and corresponding level of ink within the auxiliary reservoir 1410. This indication can be provided electronically to the printer/plotter controller and used for various purposes, including providing warning of low auxiliary reservoir levels. The circuit 1610 and coil springs essentially operate as a scale indicating the weight of the suspended mass which includes the reservoir.

Figure 16:
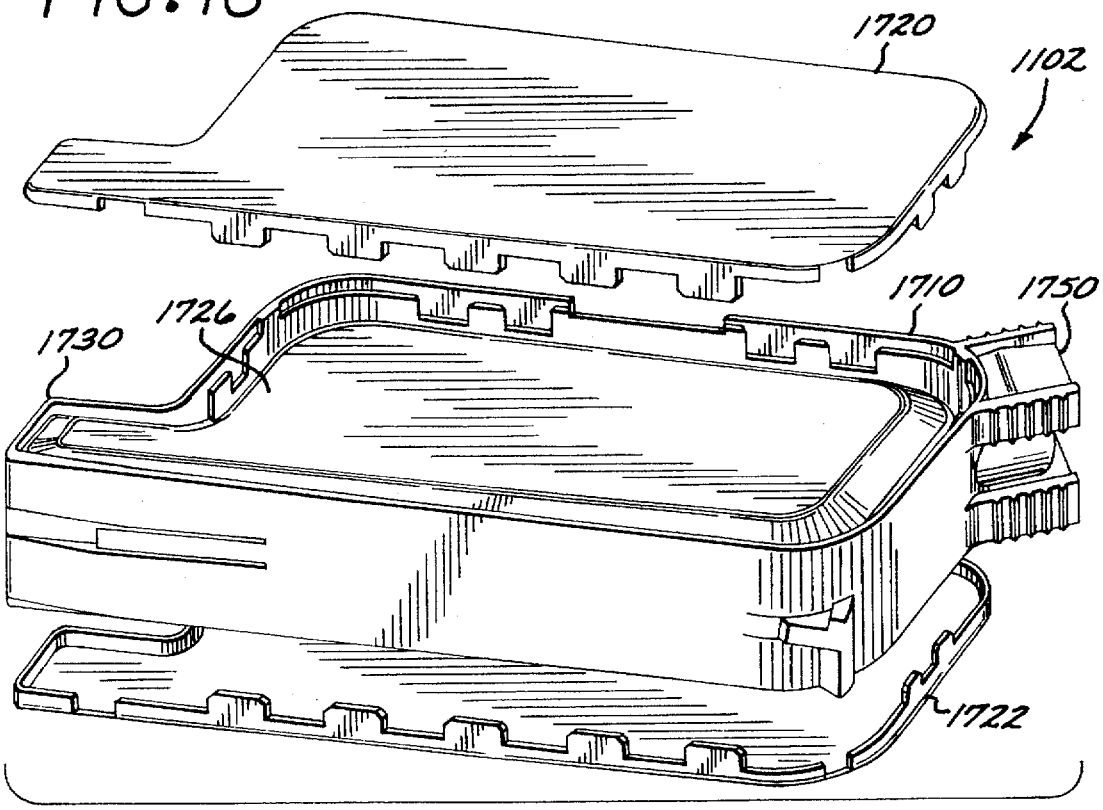
FIG. 16 is a partially exploded view of a spring bag cartridge adapted for use with the printer/plotter of FIG. 10.

FIGS. 16–20 illustrate an exemplary spring bag cartridge 1102 particularly adapted for connection to an auxiliary reservoir in accordance with the invention. The cartridge 1102 is generally similar to the cartridge 10 of FIGS. 1–7, except that an ink replenishment port 1750 is provided at a handle corner of the cartridge frame located diagonally from the cartridge snout region 1730. The cartridge includes the peripheral frame structure 1710, to which the side plates 1720 and 1722, shown in the exploded view of FIG. 16, are attached. One of the bag membranes 1726 is visible in FIG. 16. The frame structure 1710 includes a rigid outer frame member 1712 (generally corresponding to frame 20 of FIG. 1) and an inner frame member 1714 (generally corresponding to frame element 20 of FIG. 1), formed of a softer plastic material. A preferred material suitable for use in the fabrication of the inner frame member 1714 is described in co-pending application Ser. No. 08/058,730, filed May 3, 1993, entitled "Two Material frame Having Dissimilar Properties for Thermal Ink-Jet Cartridge." The bag membranes are attached to the frame member 1714.

Figure 17:
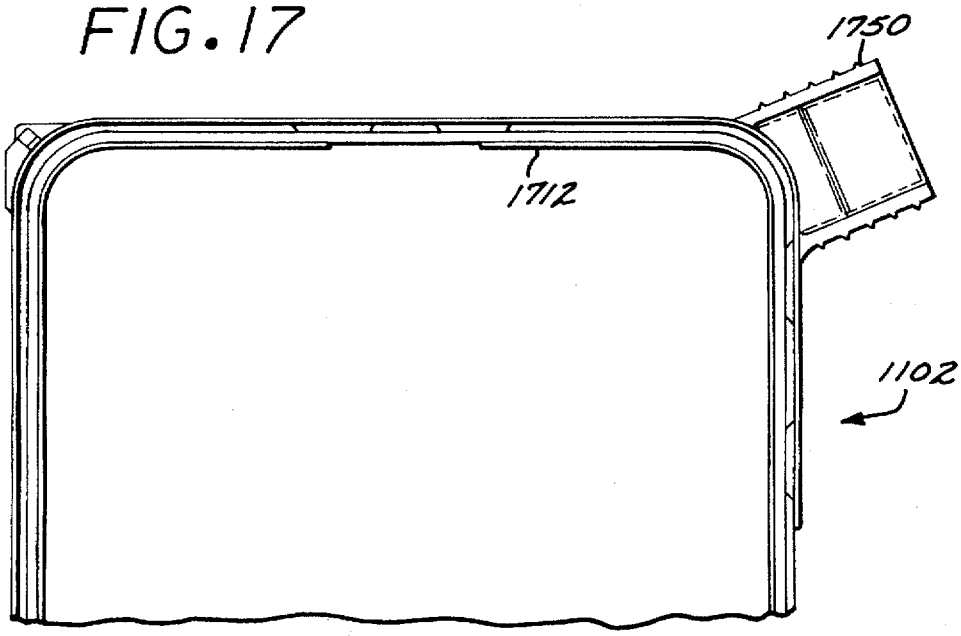
FIG. 17 is a side view illustrating the replenishment port of the cartridge, adapted to be connected to a tube for replenishment with ink from an auxiliary reservoir.
Figure 18:
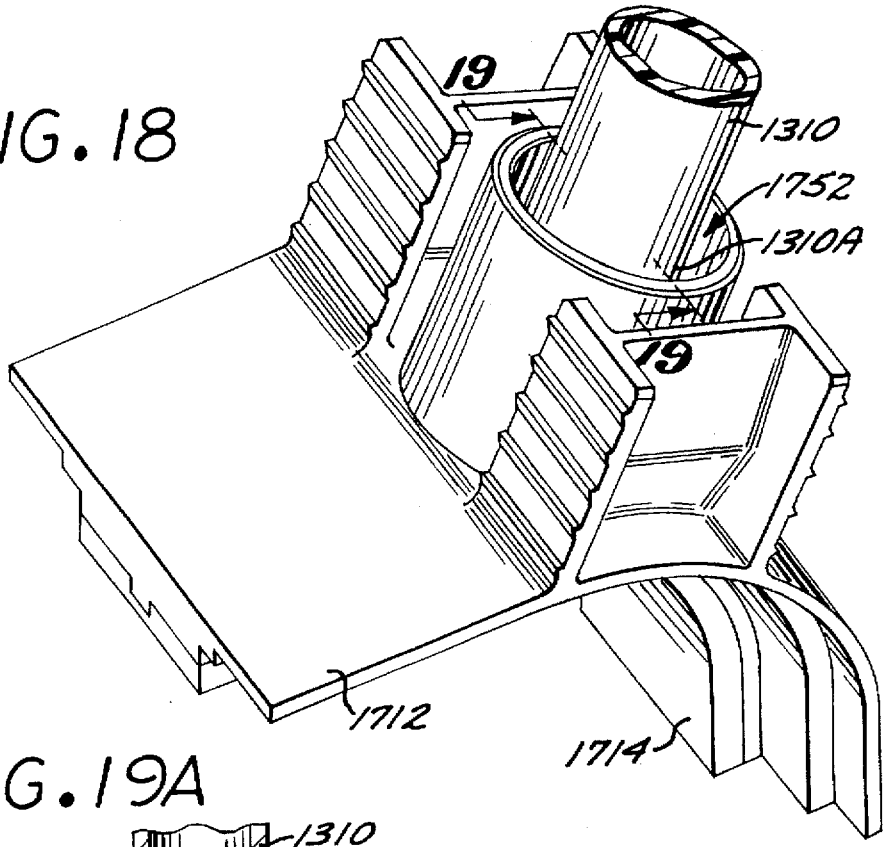
FIG. 18 shows in isolation the area of the replenishment port of the frame structure comprising the cartridge.
Figure 19A:
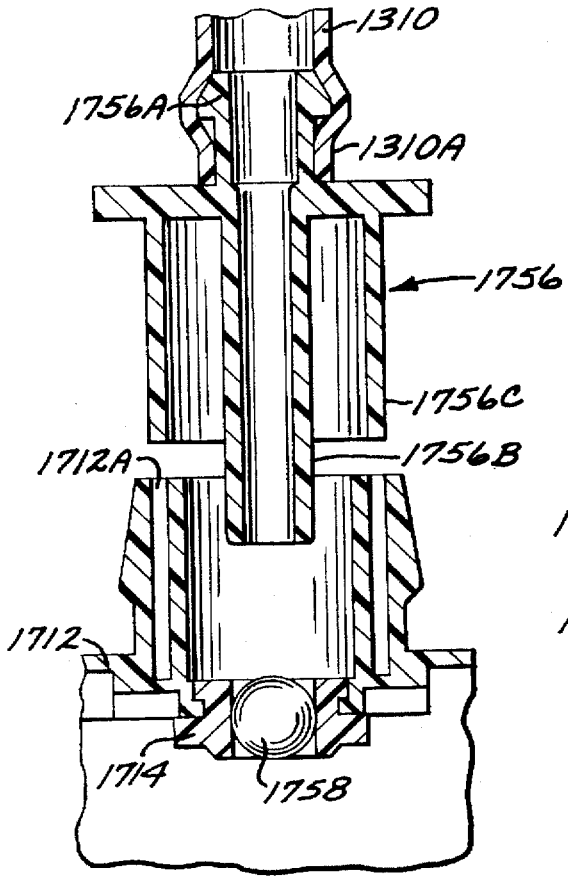
FIGS. 19A and 19B are cross-sectional views taken along line 19—19 of FIG. 18, and illustrate the connection of the tube to the replenishment port.
Figure 19B:
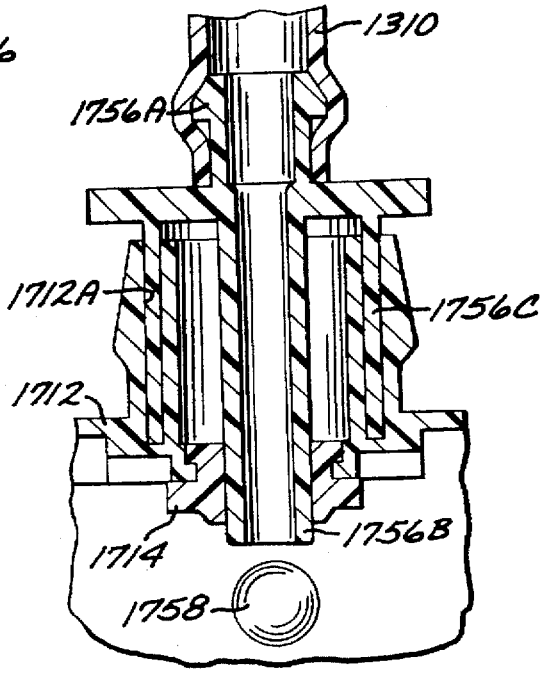

FIG. 17 is a side view showing the rigid frame member 1712. FIGS. 18–19 show an exemplary embodiment of the replenishment port and tube connection. Essentially, an opening 1752 is molded into a corner of the rigid frame member 1712, and this opening is in fluid communication with the internal cartridge reservoir. The softer inner plastic member 1714 lines the opening 1752 defined by the rigid plastic member 1712. A tube fitting 1756 provides a barb adaptor 1756A for attaching the end 1310A of the flexible tube 1310 which leads to the auxiliary reservoir. The tube fitting includes a short hollow tube 1756B for insertion into the opening 1752. The fitting further includes an outer tubular element 1756C which is received in mating recess 1712A formed in the rigid plastic member 1712. The opening 1752 can in some applications be initially plugged with a steel ball 1758, e.g., where the cartridge is filled and then placed in inventory prior to connection to the tube 1310. The tube 1756B of the fitting will displace the ball into the reservoir as the fitting tube is inserted into the opening 1752, and is received tightly within the opening to form a seal. Ink can then flow through the flexible tube 1310 and rigid tube 1756B from the auxiliary reservoir into the primary spring-bag reservoir. The opening 1752 could be resealed after removal of the fitting 1756 by pushing another ball plug into the opening.

The tube connection structure shown in FIGS. 18 and 19 is by way of example only. Other types of tube connecting apparatus could alternately be employed. For example, some applications may simply employ an opening through the frame through which an end of the flexible tube is inserted.

FIGS. 21–25 illustrate in further detail an exemplary auxiliary reservoir 1410, connection tube 1310 and cartridge 1102. The tube 1310 has a first end 1310A connected into a port of the primary spring-bag reservoir. The tube 1310 is further connected at its second end 1310B to the auxiliary reservoir 1410, as illustrated in FIGS. 21–25. The reservoir 1410 includes a fitment element 1420 which provides a structure to which the tube end 1310B can be attached. The fitment 1420 includes a tube 1420A extending transversely to a "q" shaped fitment flat structure portion 1420B. There is a tube opening 1420C extending through the tube and flat structure portion. The flat structure portion 1420B has a flat surface 1420E which is attached to the bag material, and a series of channels 1420D formed in the surface opposed to the flat surface. The channels lead to the tube opening 1420C, and serve to prevent the opening from being closed by the bag material as the bag empties and collapses. Thus, the channels allow the bag to be more completely emptied of ink. The fitment 1420 in the exemplary embodiment is a one piece structure molded from low density polyethylene.

In a preferred embodiment, the auxiliary reservoir 1410 is a bag fabricated of a flexible material impervious to the liquid ink, and can be the same material as that used for the spring bag membranes in the spring bag cartridge. A suitable bag material is a commercially available assembly of two thin layers adhered together, a two mil thick layer of polyethylene, and a 0.75 mil thick layer of polyester (MYLAR) on the bag exterior. The auxiliary reservoir bag can be fabricated in accordance with the following exemplary method.

First, a piece of the bag material about six inches wide and twenty-four inches long is cut. Next, a ¼ inch hole is punched in the very center of the bag material for the fitment element 1420. The piece of bag material is placed over the fitment with the fitment tube 1420A inserted through the hole in the material. The fitment position is adjusted so that its long dimension is parallel to the long side of the piece of material. Next, a two-inch-by-two-inch piece of teflon cloth with a ¼ inch hole punched in it is placed over the fitment tube 1420A, so that the bag material and teflon cloth sandwich the fitment element 1420. A fitment welder is used to heat weld the fitment to the bag material. The fitment welder can be a hollow aluminum cylinder attached to a soldering iron, with the cylinder defining a clearance opening larger than the diameter of the fitment tube. The temperature can be controlled by unplugging the soldering iron, etc., to get the best fitment seal. A cylinder of rolled teflon cloth is placed over the fitment tube 1420A to protect it from melting. A second cylinder of rolled teflon cloth is placed inside the clearance hole of the fitment welder. The welder is carefully lowered over the fitment tube and pressed down to melt the bag material and the fitment together. This welding will require a rather fast rolling motion to prevent melting the fitment tube or excess melting of the bag but also must assure a complete bag to fitment seal.

Once the fitment is in place, the periphery of the bag can be sealed with impulse heat sealers typically used on plastic bags. The piece of bag material is folded over in the long direction to end up with a bag six-inches-by-twelve inches with the fitment tube protruding out of one side wall of the bag. The long edges of the bag material are lined up, and the short end of the bag is heat sealed about 11½ inches from the fitment end. A second seal can be placed next to the first one for added sealing security. Then each of the long edges of the bag are sealed about one inch from the edge. A second seal can be placed right next to the first seal for added sealing security. The bag should now have a sealed area of about four-inches-by-eleven-and-one-half-inches with the fitment tube 1420A protruding from one side wall of the bag. When filled with liquid ink, this exemplary bag will have a vertical height dimension on the order of 1½ inches.

The auxiliary reservoir bag 1420 can be filled by at least two exemplary methods. One method is syringe filling. Ink is pulled into a syringe, the syringe is connected to the bag fitment tube through a luer fitting, and the ink is pushed into the bag. Another method is siphon filling. The bag 1420 is placed at a lower level than the free liquid level in an ink bottle. A tube is placed in the ink bottle. A "tee" is connected between a luer fitting on the bag 1420 and the tube from the bottle. A syringe is attached to the open end of the "tee." When the syringe is used to evacuate the tube and bag of air, the ink that is pulled out of the bottle starts a siphoning action into the bag 1420. Once the bag has the required amount of ink in it, the luer fitting can be capped with a male luer plug. To remove any air bubbles, the bag is oriented to get any air bubbles to collect at the fitment and the plug is opened enough to let the air escape. The auxiliary reservoir bag 1420 can be refilled by the same techniques.

An L luer fitting 1430 is attached to the fitment tube 1420A by pressing a barbed end of the fitting into the tube 1420A. The tube material is flexible enough to receive the fitting end in a leak-tight joint. The exposed end of the fitting 1430 is also barbed, and the end 1310B of the tube is pushed onto the barbed end to make the connection.

To attach the cartridge 1102 to the auxiliary reservoir bag 1410, it is helpful if a "T" tube fitting 1320 is inserted in the tube 1310 which will run between the cartridge and reservoir. This permits air bubbles to be released prior to use.

In an exemplary embodiment, the tube 1310 has an inner diameter of ⅛ inches to permit adequate flow and without relying on capillary flow.

Figure 21:
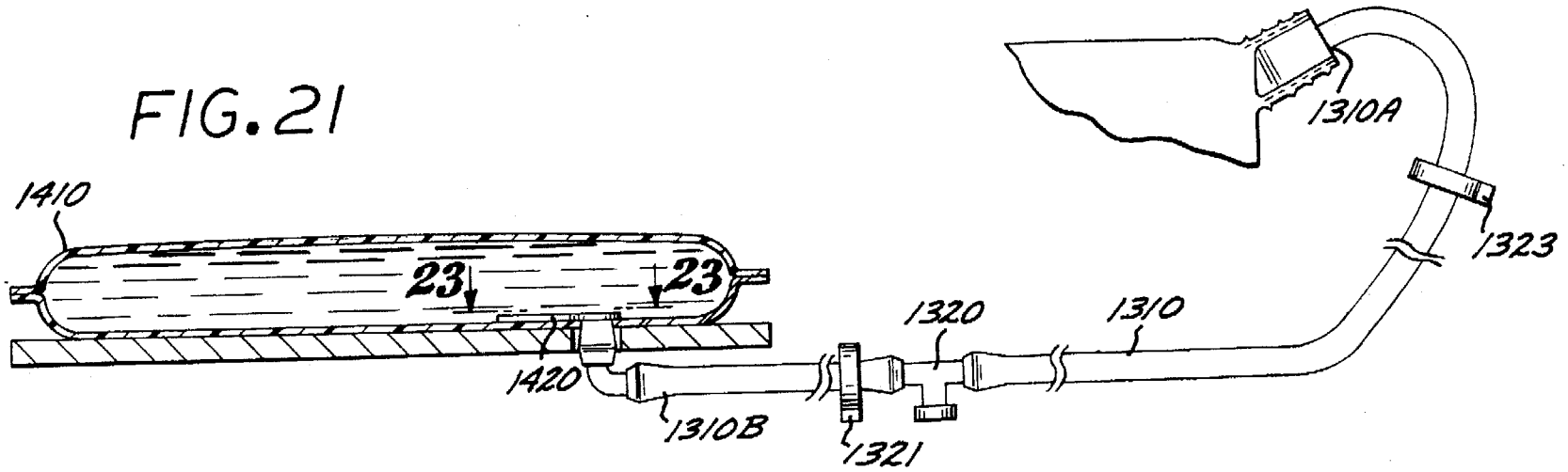
FIG. 21 illustrates the closed ink path between the spring-bag cartridge and the auxiliary reservoir.
Figure 22:
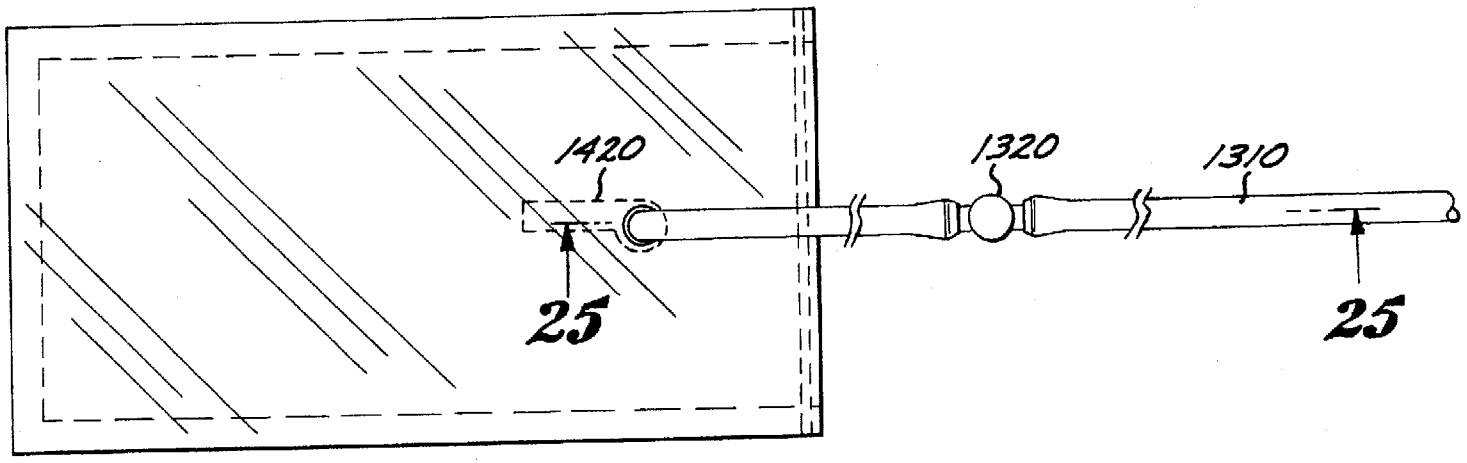
FIG. 22 is a bottom view of the auxiliary reservoir bag and tube.
Figure 23:
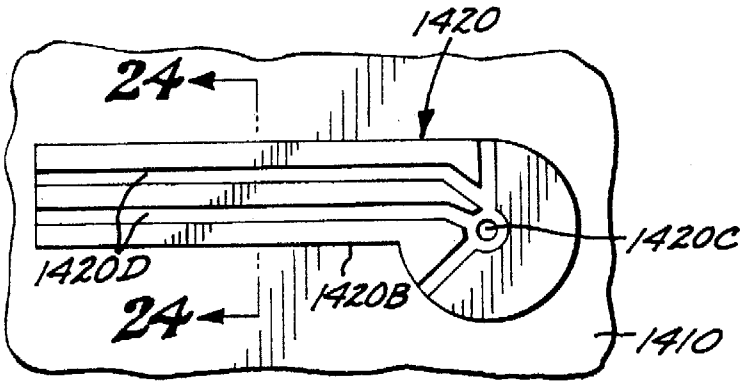
FIG. 23 is a broken away view of the auxiliary reservoir bag, taken along line 23—23 of FIG. 21, showing the fitment element.
Figure 24:
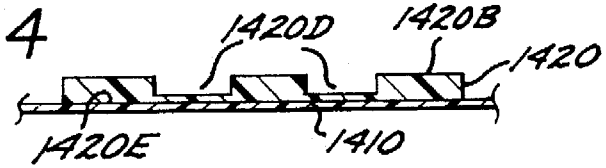
FIG. 24 is a cross-sectional view of the fitment element, taken along line 24-24 of FIG. 23.
Figure 25:
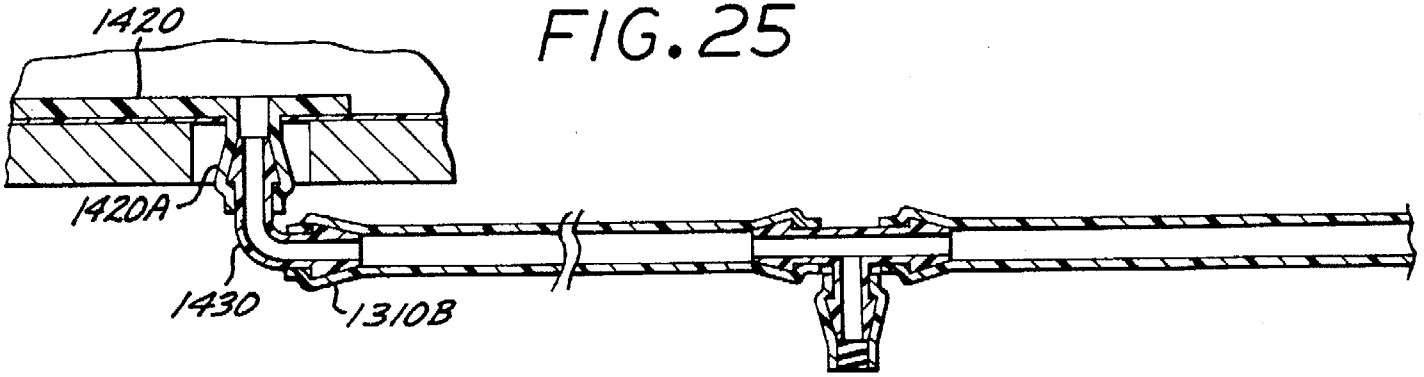
FIG. 25 is a broken-away, cross-sectional view of the reservoir bag, fitment element and the connection tube taken along lines 25—25 of FIG. 22.

When the cartridge reservoir and auxiliary reservoir are not installed in a printer, e.g., during shipping or in inventory, there is the risk that the height differential between the cartridge and auxiliary reservoir will not be at the correct differential to prevent ink flow from the reservoir to the cartridge, allowing ink drool from the print head. To prevent this, a shut-off valve will typically be installed in the fluid path between the auxiliary reservoir and the cartridge to prevent ink flow when the cartridge/auxiliary reservoir are not installed in a printer. This may be a simple pinch valve for closing the tube, for example. Such valves are schematically illustrated in FIG. 21 as elements 1321 and 1323.

In a practical implementation of a printer embodying this invention, the closed fluid path between the cartridge and auxiliary reservoir may be defined by a tube which is in essence a tubing system, wherein a portion of the fluid path is defined by a printer tube which is a permanent part of the printer, in that it is not intended to be replaced when a cartridge or auxiliary reservoir is replaced. This "permanent" tube can be installed with the wiring harness also connecting to elements on the cartridge carriage, and tube connectors installed to permit ready connection of the cartridge, or short tubing sections connected to the cartridge to one end thereof, and/or of the auxiliary reservoir, or a short tubing section connected to the auxiliary reservoir, to the other end. In such an implementation, the cartridges and auxiliary reservoirs could be fabricated with short lengths of tubing attached to the ports, with removable caps or plugs sealing the tubing prior to connecting these elements into the printer. As another alternate arrangement, to facilitate the ease of fitting the cartridge with its tube into the carriage, a small diameter tube may be used to connect into the port of the cartridge, which can be more easily positioned in the carriage than a larger diameter tube. The small diameter tube could then be connected to the larger diameter, "permanent" tube running to the auxiliary reservoir.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An ink-jet printer/plotter for ink-jet printing onto a print media, comprising:

an ink-jet cartridge including an ink-jet print head and a spring-bag primary ink reservoir in fluid communication with said print head for holding an internal supply of liquid ink under negative pressure, said reservoir including a movable side wall and an internal spring for biasing said side wall against collapsing as ink is withdrawn from said reservoir and ejected from said print head onto a print medium during printing operations;

a printer/plotter frame;

a print media advancing mechanism for advancing a print medium along a medium path in a media advance direction to a print area;

a cartridge carriage for holding the cartridge;

a cartridge carriage drive mechanism for moving the cartridge carriage relative to the frame along a carriage axis for printing a swath;

an auxiliary ink reservoir secured relative to the frame for holding an auxiliary supply of liquid ink;

a connection tube connectable between said primary reservoir and the auxiliary reservoir for providing a fluid path between the primary and auxiliary reservoirs; and apparatus for moving the auxiliary reservoir up and/or down without manual intervention during ink replenishment operations to position the ink reservoir at a vertical height position relative to the spring bag internal reservoir.

2. The printer/plotter of claim 1 wherein the auxiliary reservoir holds a large quantity of liquid ink to result in little variation in back pressure as ink is consumed.

3. The printer/plotter of claim 1 wherein the auxiliary reservoir is flat with relatively large depth and width dimensions in relation to a smaller vertical dimension of said auxiliary reservoir.

4. The printer/plotter of claim 1 wherein said height position of said auxiliary reservoir is below a height at which the print head is disposed while the cartridge is secured in the carriage for printing operation.

5. The printer/plotter of claim 1 wherein said cartridge includes a rigid frame structure enclosing the primary reservoir, the print head is secured to a surface of the frame structure which faces the print medium undergoing printing operation, and wherein said tube is connectable to said primary reservoir through a port extending through the frame structure.

6. The printer/plotter of claim 1 wherein said cartridge includes a rigid frame structure enclosing the primary reservoir, the print head is secured to a surface of the frame structure which faces the print medium undergoing printing operation, and wherein said tube is connectable to said primary reservoir through a replenishment port extending through the frame structure in a direction which does not face the print medium.

7. The printer/plotter of claim 6 wherein said cartridge further includes an ink fill port extending through the cartridge frame in a wall of said frame facing said print medium, said fill port being sealed with a sealing member.

8. The printer/plotter of claim 1 wherein said auxiliary reservoir comprises a sealed bag, the bag including first and second side walls having respective edges sealed together, the bag side walls fabricated of a thin flexible material which is impervious to the liquid ink.

9. The printer/plotter of claim 8 wherein the auxiliary reservoir bag is flat with relatively large depth and width dimensions in relation to a height dimension.

10. The printer/plotter of claim 9 wherein said auxiliary reservoir positioning means includes a platform for supporting said reservoir in repose on one of said bag side walls.

11. The printer/plotter of claim 1 further comprising a flexible electrical wiring harness connecting said cartridge and a controller mounted in a housing, and wherein said connection tube is connected with said wiring harness to be carried with said wiring harness as said carriage is moved along said carriage axis.

12. The printer/plotter of claim 1 wherein said apparatus for moving the auxiliary reservoir up and/or down includes a weight sensitive platform which moves vertically to maintain proper ink back pressure in the primary ink reservoir.

13. A multicolor ink-jet printer/plotter for ink-jet printing onto a print media, comprising:

a printer/plotter frame structure;

a plurality of ink-jet cartridges for printing with liquid ink of a plurality of colors, each cartridge including an ink-jet print head and a closed spring-bag primary reservoir in fluid communication with said print head for holding an internal supply of liquid ink under negative pressure, said reservoir including a first movable side wall and an internal spring for biasing said side wall against collapsing as ink is withdrawn from said primary reservoir and ejected from said printhead onto a print medium during printing operations;

a print media advancing mechanism for advancing a print medium in sheet form along a medium path in a media advance direction to a print area;

a cartridge carriage for holding the cartridges in registered positions;

a carriage drive mechanism for moving the carriage in relation to the frame structure along a carriage axis for printing a swath;

a corresponding plurality of closed auxiliary ink reservoirs each for holding an auxiliary supply of liquid ink;

a plurality of connection tubes, one each for connecting between a given primary reservoir and its corresponding auxiliary reservoir for providing a closed fluid path between the corresponding primary and auxiliary reservoirs during ink replenishment operations; and apparatus for moving the auxiliary reservoirs up and down during ink replenishment operations without manual intervention to position the respective auxiliary reservoirs at respective vertical positions relative to the primary reservoirs to regulate the back pressure in each primary reservoir.

14. The printer/plotter of claim 13 wherein the auxiliary reservoirs hold a large quantity of liquid ink to result in little variation in back pressure as ink is consumed.

15. The printer/plotter of claim 13 wherein the auxiliary reservoirs are flat with relatively large depth and width dimensions in relation to a smaller vertical height dimension of said auxiliary reservoirs.

16. The printer/plotter of claim 13 wherein said vertical height positions of said auxiliary reservoirs are below a vertical height at which the corresponding cartridge print head is disposed while the cartridges are secured in the carriage for printing operation.

17. The printer/plotter of claim 13 wherein said cartridges each includes a rigid frame structure enclosing the primary reservoir, the print head is secured to a surface of the frame structure which faces the print medium undergoing printing operation, and wherein said corresponding tube is connectable to said primary reservoir through a replenishment port extending through the frame structure.

18. The printer/plotter of claim 13 wherein said cartridges each includes a rigid frame structure enclosing the primary reservoir, the print head is secured to a surface of the frame structure which faces the print medium undergoing printing operation, and wherein said corresponding tube is connectable to said primary reservoir through a replenishment port extending through the frame structure which does not face the print medium.

19. The printer/plotter of claim 18 wherein each said cartridge includes an ink fill port extending through the cartridge frame in a wall of said frame facing said print medium, said fill port being sealed with a sealing member after said primary reservoir has been filled with ink.

20. The printer/plotter of claim 13 wherein each said auxiliary reservoir comprises a sealed bag, the bag including first and second side walls having respective edges sealed together, the bag side walls fabricated of a thin flexible material which is impervious to the liquid ink.

21. The printer/plotter of claim 20 wherein each said auxiliary reservoir bag is flat with relative large depth and width dimensions.

22. The printer/plotter of claim 21 wherein said auxiliary reservoir moving apparatus includes platform structure for supporting each of said reservoirs in repose on one of said bag side walls.

23. The printer/plotter of claim 13 wherein each said auxiliary reservoir comprises a second movable side wall.

24. The printer/plotter of claim 13 wherein said apparatus for moving the auxiliary reservoirs up and/or down includes a plurality of weight sensitive platform which move vertically to maintain proper ink back pressure in the primary ink reservoirs.

25. An ink-jet printer/plotter for ink-jet printing onto a print media, comprising:

an ink-jet cartridge including an ink-jet print head and a closed spring-bag primary reservoir in fluid communication with said print head for holding a primary supply of liquid ink under negative pressure, said primary reservoir including a first movable side wall and an internal spring for biasing said movable side wall against collapsing as ink is withdrawn from said primary reservoir and ejected from said print head onto a print medium during printing operations;

a print media advancing mechanism for advancing a print medium along a medium path in a media advance direction to a print area;

a cartridge carriage for holding the cartridge in a registered position;

a carriage drive mechanism for driving the carriage along a carriage axis for printing a swath;

an auxiliary ink reservoir for holding an auxiliary supply of liquid ink;

a connection tube connectable between said internal pen reservoir and the auxiliary reservoir for providing a closed fluid path between the primary and auxiliary reservoirs during ink replenishment operations; and height regulating apparatus for regulating a height position of the auxiliary reservoir relative to the height of the cartridge print head to maintain a substantially constant back pressure in said primary reservoir while a supply of ink remains in the auxiliary reservoir, said height position being dependent on the amount of ink in said auxiliary reservoir, said height regulating apparatus for moving the auxiliary reservoir up and down during ink replenishment operations without manual intervention.

26. The printer/plotter of claim 25 further comprising means for sensing the ink volume remaining in the auxiliary reservoir.

27. The printer/plotter of claim 25 wherein said height regulating apparatus includes a weight sensitive platform which moves vertically to maintain proper ink back pressure in the primary ink reservoir.

28. An ink-jet printer/plotter for ink-jet printing onto a print media, comprising:

an ink-jet cartridge including a cartridge frame, an ink-jet print head, a closed spring-bag primary ink reservoir in fluid communication with said print head for holding an internal supply of liquid ink under negative pressure, said reservoir including first and second flexible side walls and an internal spring for biasing said side walls against collapsing together as ink is withdrawn from said reservoir and ejected from said print head onto a print medium during printing operations, and an ink replenishment port extending through said frame into said reservoir;

a printer/plotter frame;

a print media advancing mechanism for advancing a print medium along a medium path in a media advance direction to a print area;

a cartridge carriage for holding the cartridge;

a cartridge carriage drive mechanism for moving the cartridge carriage relative to the frame along a carriage axis for printing a swath;

a closed, air-tight auxiliary ink reservoir secured relative to the frame for holding an auxiliary supply of liquid ink;

a connection tube for connecting between said ink replenishment port of said cartridge and the auxiliary reservoir for providing a closed fluid path between the primary and auxiliary reservoirs; and apparatus for positioning the auxiliary reservoir at a vertical height position relative to the spring bag internal reservoir so as not to destroy the back pressure, said apparatus for moving the auxiliary reservoir up and down without manual intervention during ink replenishment operations.

29. The printer/plotter of claim 28 wherein the auxiliary reservoir is flat with relatively large depth and width dimensions in relation to a smaller vertical dimension of said auxiliary reservoir.

30. The printer/plotter of claim 28 wherein said height position of said auxiliary reservoir is below a height at which the print head is disposed while the cartridge is secured in the carriage for printing operation.

31. The printer/plotter of claim 28 wherein said print head is secured to a surface of the frame which faces the print medium undergoing printing operation, and said port extending through the frame structure also faces said print medium during printing operations.

32. The printer/plotter of claim 28 wherein said print head is secured to a surface of the frame structure which faces the print medium undergoing printing operation, and wherein said port extends through the frame structure in a direction which does not face the print medium.

33. The printer/plotter of claim 32 wherein said port extends through the frame structure at a corner of said frame.

34. The printer/plotter of claim 28 wherein said auxiliary reservoir comprises a sealed bag, the bag including first and second side walls having respective edges sealed together, the bag side walls fabricated of a thin flexible material which is impervious to the liquid ink.

35. The printer/plotter of claim 34 wherein the auxiliary reservoir bag is flat with relatively large depth and width dimensions in relation to a height dimension.

36. The printer/plotter of claim 28 wherein said frame includes first and second external side cover elements, and wherein said first and second flexible side walls do not touch said external side cover elements when said primary reservoir is filled with ink.

37. The printer/plotter of claim 28 wherein said apparatus for positioning the auxiliary reservoir includes a weight sensitive platform which moves vertically to maintain proper ink back pressure in the primary ink reservoir.

38. An ink-jet printer/plotter for ink-jet printing onto a print media, comprising:

an ink-jet cartridge including an ink-jet print head and a closed spring-bag primary reservoir in fluid communication with said print head for holding a primary supply of liquid ink under negative pressure, said primary reservoir including a first movable side wall and an internal spring for biasing said movable side wall against collapsing as ink is withdrawn from said primary reservoir and ejected from said print head onto a print medium during printing operations;

a print media advancing mechanism for advancing a print medium along a medium path in a media advance direction to a print area;

a cartridge carriage for holding the cartridge in a registered position;

a carriage drive mechanism for driving the carriage along a carriage axis for printing a swath;

an auxiliary ink reservoir for holding an auxiliary supply of liquid ink;

a connection tube for connecting between said internal pen reservoir and the auxiliary reservoir for providing a closed fluid path between the primary and auxiliary reservoirs;

means for sensing the weight of the auxiliary reservoir; and height regulating means for regulating a height position of the auxiliary reservoir relative to the height of the cartridge print head to maintain a substantially constant back pressure in said primary reservoir while a supply of ink remains in the auxiliary reservoir, said height position being dependent on the amount of ink in said auxiliary reservoir.

39. An ink-jet printer/plotter for ink-jet printing onto a print media, comprising:

an ink-jet cartridge including an ink-jet print head and a closed spring-bag primary reservoir in fluid communication with said print head for holding a primary supply of liquid ink under negative pressure, said primary reservoir including a first movable side wall and an internal spring for biasing said movable side wall against collapsing as ink is withdrawn from said primary reservoir and ejected from said print head onto a print medium during printing operations;

a print media advancing mechanism for advancing a print medium along a medium path in a media advance direction to a print area;

a cartridge carriage for holding the cartridge in a registered position;

a carriage drive mechanism for driving the carriage along a carriage axis for printing a swath;

an auxiliary ink reservoir for holding an auxiliary supply of liquid ink;

a connection tube for connecting between said internal pen reservoir and the auxiliary reservoir for providing a closed fluid path between the primary and auxiliary reservoirs;

means for sensing the ink volume remaining in the auxiliary reservoir; and height regulating means for regulating a height position of the auxiliary reservoir relative to the height of the cartridge print head to maintain a substantially constant back pressure in said primary reservoir while a supply of ink remains in the auxiliary reservoir, said height position being dependent on the amount of ink in said auxiliary reservoir, said height regulating means comprising a support structure for supporting the auxiliary reservoir and means for adjusting the height of the auxiliary reservoir in relation to the height of said print head as the volume of ink within the auxiliary reservoir decreases, and said sensing means comprising means for sensing changes in said height of said support structure.

40. An ink-jet printer/plotter for ink-jet printing onto a print media, comprising:

an ink-jet cartridge including an ink-jet print head and a closed spring-bag primary reservoir in fluid communication with said print head for holding a primary supply of liquid ink under negative pressure, said primary reservoir including a first movable side wall and an internal spring for biasing said movable side wall against collapsing as ink is withdrawn from said primary reservoir and ejected from said print head onto a print medium during printing operations;

a print media advancing mechanism for advancing a print medium along a medium path in a media advance direction to a print area;

a cartridge carriage for holding the cartridge in a registered position;

a carriage drive mechanism for driving the carriage along a carriage axis for printing a swath;

an auxiliary ink reservoir for holding an auxiliary supply of liquid ink;

a connection tube for connecting between said internal pen reservoir and the auxiliary reservoir for providing a closed fluid path between the primary and auxiliary reservoirs; and height regulating means for regulating a height position of the auxiliary reservoir relative to the height of the cartridge print head to maintain a substantially constant back pressure in said primary reservoir while a supply of ink remains in the auxiliary reservoir, said height position being dependent on the amount of ink in said auxiliary reservoir, said height regulation means comprising a support structure for supporting the auxiliary reservoir, and height adjusting apparatus for adjusting the height of the support structure in dependence on the weight of the auxiliary reservoir and said auxiliary supply of ink, wherein the support structure height rises as ink is drawn from said auxiliary reservoir, thereby lightening the reservoir and auxiliary ink supply.

41. The printer/plotter of claim 40 wherein said height adjusting apparatus includes a spring biasing mechanism for providing an upward biasing force on said support structure, wherein as said auxiliary reservoir is drained of ink, said spring force acting on said support structure causes said auxiliary reservoir to rise relative to a starting height position.

42. The printer/plotter of claim 41 wherein said spring biasing mechanism includes a coiled spring compressed between a base structure and said support structure.

43. A method for replenishing a supply of ink within a reservoir for liquid ink for an ink-jet printer, comprising the following steps:

providing an ink-jet cartridge including an ink-jet print head and a closed spring-bag primary ink reservoir in fluid communication with said print head for holding an internal supply of liquid ink under negative pressure, said reservoir including a movable side wall and an internal spring for biasing said side wall against collapsing as ink is withdrawn from said reservoir and ejected from said print head onto a print medium during printing operations;

providing a cartridge carriage for holding the cartridge, with a cartridge carriage drive mechanism for moving the cartridge carriage along a carriage axis for printing a swath;

providing an auxiliary supply of ink in a closed auxiliary ink reservoir displaced from the carriage connectable to the cartridge through an ink flow tube; and moving the auxiliary reservoir up and/or down during ink replenishment operations without manual intervention to position the ink reservoir at a vertical height position relative to the spring bag internal reservoir so as not to destroy the back pressure.

44. The method of claim 43 wherein said step of moving the auxiliary reservoir up and/or down includes supporting the auxiliary reservoir on a weight sensitive platform which moves vertically to maintain proper ink back pressure in the cartridge reservoir.

45. An ink-jet printer/plotter for ink-jet printing onto a print media, comprising:

an ink-jet cartridge including an ink-jet print head and an internal ink reservoir in fluid communication with said print head for holding an internal supply of liquid ink under negative pressure;

a printer/plotter frame;

a print media advancing mechanism for advancing a print medium along a medium path in a media advance direction to a print area;

a cartridge carriage for holding the cartridge;

a cartridge carriage drive mechanism for moving the cartridge carriage relative to the frame along a carriage axis for printing a swath;

an auxiliary ink reservoir secured relative to the frame for holding an auxiliary supply of liquid ink;

a connection tube connectable between said primary reservoir and the auxiliary reservoir for providing a fluid path between the internal and auxiliary reservoirs; and apparatus for moving the auxiliary reservoir up and/or down without manual intervention during ink replenishment operations to position the ink reservoir at a vertical height position relative to the internal reservoir.

46. The printer/plotter of claim 45 wherein said apparatus for moving the auxiliary reservoir includes a weight sensitive platform which moves vertically to maintain proper ink back pressure in the internal ink reservoir.

* * * * *